US007866075B2

(12) United States Patent
Meeker et al.

(10) Patent No.: US 7,866,075 B2
(45) Date of Patent: Jan. 11, 2011

(54) BUTTON CAPTURE SIGN SYSTEM

(75) Inventors: Donald T. Meeker, Larchmont, NY (US); Christopher O'Hara, Yorktown Heights, NY (US)

(73) Assignee: Meeker & Associates, Inc., Larchmont, NY (US)

( * ) Notice: Subject to any disclaimer, the term of this patent is extended or adjusted under 35 U.S.C. 154(b) by 307 days.

(21) Appl. No.: 12/006,903

(22) Filed: Jan. 7, 2008

(65) Prior Publication Data

US 2009/0172985 A1 Jul. 9, 2009

(51) Int. Cl.
*G09F 15/00* (2006.01)

(52) U.S. Cl. ..... 40/606.01; 40/607.01; 40/611.12; 40/611.13; 40/607.15; 248/466; 248/477; 248/488

(58) Field of Classification Search ..... 40/606.01, 40/607.01, 611.12, 611.13, 620, 607.13, 40/607.15, 729, 605, 607.12, 606.13; 52/509
See application file for complete search history.

(56) References Cited

U.S. PATENT DOCUMENTS 2,341,777 A * 2/1944 Hensel ..... 52/598
3,905,169 A * 9/1975 Gallo ..... 52/137
3,981,117 A * 9/1976 Dehlen ..... 52/509
4,545,167 A * 10/1985 Brock ..... 52/509
4,638,618 A * 1/1987 Iesaka et al. ..... 52/509
4,757,664 A * 7/1988 Freissle ..... 52/509
4,793,083 A 12/1988 McDonald
5,181,335 A 1/1993 Todd
5,333,423 A * 8/1994 Propst ..... 52/126.6
5,671,852 A * 9/1997 Maharg ..... 211/189
6,199,328 B1 * 3/2001 McGrath et al. ..... 52/127.1
6,293,328 B1 * 9/2001 Fremont ..... 160/135
6,718,709 B2 * 4/2004 Koutras et al. ..... 52/285.1
2002/0124515 A1 * 9/2002 Pacione ..... 52/509

* cited by examiner

*Primary Examiner*—Gary C Hoge
(74) *Attorney, Agent, or Firm*—Cohen Pontani Lieberman & Pavane LLP

(57) ABSTRACT

A single or double post sign structure that is configured to accommodate the attachment of panels to one or both sides of a vertical upright. The sign panel is provided with keyed indentations that are located at the top and bottom edges of the panel to permit capture and rigid securement of the sign panel by a pair of retaining buttons that are used to anchor the sign panel to the sign post. Each retaining button is provided with protrusions corresponding to the keyed indentations of the sign panel. As a result, when the protrusion of the retaining button is engaged and seated in the keyed indentation of the sign panel, it becomes locked in place so that there is no room for lateral movement or removal of the panel. As a result, vandals or thieves are prevented from laterally sliding the sign panel to improperly remove it.

20 Claims, 20 Drawing Sheets

Double Face Exploded View

Single Face Single Post Assembled View

Single Face Single Post Exploded View

Single Face Single Post Connection

Double Face Single Post Assembled View

Double Face Exploded View

Double Face Double Post Connection

Single Face Single Post Connection

Single Face Double Post Connection

Part 1 Single Screw

Front View

Back View

Side View

Part 2 Single Screw

Front View

Back View

Side View

Part 3 Single Screw

Front View

Side View

Back View

Part 4 Single Screw

Front View

Side View

Back View

Part 5 Double Screw

Front View

Back View

Side View

Part 6 Double Screw

Front View

Back View

Side View

Part 7 Double Screw

Front View

Side View

Back View

Part 8 Double Screw

Front View

Side View

Back View

Part 1 Single or Double Screw (Universal)

Front View

Side View

Back View

Part 1 Single or Double Screw–Post Mount Detail

Assembled

Part 2 Single or Double Screw (Universal)

Front View

Side View

Back View

Part 2 Single or Double Screw–Post Mount Detail

Assembled

Part 3 Single Screw

Front View

Side View

Back View

Part 3 Single Screw–Post Mount Detail (Double-sided)

Assembled

Part 3 Single Screw–Wall Mount Detail

Assembled

Part 4 Single Screw

Front View

Side View

Back View

Part 4 Single Screw–Post Mount Detail (Double-sided)

Assembled

Part 4 Single Screw–Wall Mount Detail

Assembled

Part 5 Double Screw

Front View

Side View

Back View

Part 5 Double Screw–Post Mount Detail (Double-sided)

Assembled

Part 5 Double Screw–Wall Mount Detail

Assembled

Part 6 Double Screw

Front View

Side View

Back View

Part 6 Double Screw–Post Mount Detail (Double-sided)

Assembled

Part 6 Double Screw–Wall Mount Detail

Assembled

Backer Panel with Connection

Front Exploded View

Backer Panel with Connection

Rear Exploded View

BUTTON CAPTURE SIGN SYSTEM

BACKGROUND OF THE INVENTION

1. Field of the Invention

The present invention generally relates to the field of sign retainers, and more particularly, to a single or double post sign structure configured to accommodate the attachment of panels to one or both sides of a vertical upright.

2. Description of the Related Art

Conventional signs holders have a number of disadvantages. For example, U.S. Pat. No. 4,793,083 to McDonald discloses a sign panel system that is used by real estate agents. This sign system comprises a normally upright post and two holding members that are securable to a post at virtually any point of the overall length thereof. The holders are each provided with at least one but preferably two parallel transverse members defining a pair of parallel slots. The lower holder has slots for engaging lower edges of a pair of rectangular panels. The upper holder is positioned upside down and is slideably adjusted along the post to grip the top edges of the panel so as to fixedly secure the panels to the associated post. One shortcoming of such a sign holder is that the sign has no method of lateral capture and can be laterally slid, and removed by vandals. In addition, there is no way for such a sign holder to ensure that the panel is centered or consistently positioned on the upright. Moreover, a specific size and type of upright is required by this type of a sign holder.

U.S. Pat. No. 5,181,335 to Todd discloses a sign mounting arrangement, installation kit and method for enabling installation of a portable sign without the use of any tools. The portable sign mounting arrangement includes a pair of open slot mounting brackets and hand-activated clamping devices for clamping a display sign between a conventional sign post standard and the edges of the slots in each of the brackets. The sign mounting arrangement disclosed in Todd also suffers from the disadvantages of the sign system disclosed in McDonald, in that the sign may also be easily removed. In addition, the clamping devices can obscure the graphic image area of the sign panel.

Accordingly, a sign system is needed for attaching a sign panel to a sign post that is easy to install, resists damage by weather and/or vandals, which can electively use a single or double faced assembly and allows the display of one or more panels on the front or back of the installation.

SUMMARY OF THE INVENTION

According to the present invention, a single or double post sign structure is configured to accommodate the attachment of panels to one or both sides of a vertical upright. The sign panel of the present invention is a dimensioned panel that is manufactured from a half-inch material. However, it is to be understood that thinner or thicker materials can also be used, such as a ¼" to much thicker material. Preferably, the sign panel is configured from a high pressure laminate (HPL) with image data digitally printed and impregnated in the material sandwich. Moreover, it should be understood that other panel materials including plywood, particle board, or structural plastic panels can be used with painted, screen printed, or other types of flat graphic displays.

In accordance with the invention, the sign panel is provided with keyed indentations that are located at the top and bottom edges of the panel to permit capture and rigid securement of the sign panel by a pair of retaining buttons. In embodiments where the sign panel is used with single post assemblies, the keyed indentations are located at a centered position on the sign panel. In embodiments where the sign panel is used with double post assemblies, however, the keyed indentations are placed at desired positions located outwardly toward the edges of the sign panel.

The pair of retaining buttons is used to anchor the sign panel to the sign post. Each retaining button is provided with protrusions that correspond in shape and configuration to the keyed indentations of the sign panel. As a result, when the protrusions of the retaining button are engaged and seated in the keyed indentations of the sign panel and the button is secured to the upright, it becomes locked in place so that there is no room for lateral movement or removal of the panel. As a result, unwarranted removal is prevented and the panel is secured in the desired location on the post.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

The foregoing and other advantages and features of the invention will become more apparent from the detailed description of the preferred embodiments of the invention given below with reference to the accompanying drawings in which.

DETAILED DESCRIPTION OF THE EXEMPLARY EMBODIMENTS

Figure 1:
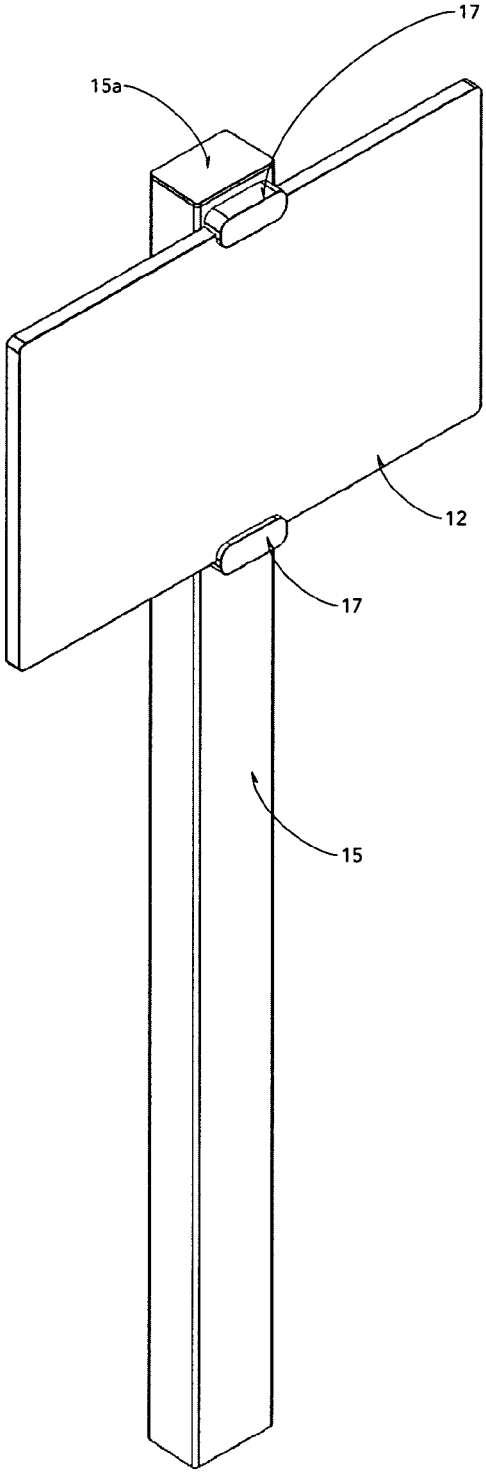
FIG. 1 is an illustration of a perspective view of a sign in accordance with the present invention.

FIG. 1 is an illustration of a perspective view of a sign system in accordance with the present invention. As shown therein, a sign panel 12 is attached to a sign post 15. The sign post 15 is a conventional vertical upright that is used to provide a means to locate a sign for general viewing. Here, the sign post 15 may be wood, re-cycled wood or a tubular metal, such as steel or aluminum. Attachment of the sign panel 12 to the sign post 15 is accomplished using retaining buttons 17, which is discussed in further detail below.

The sign panel of the invention is a dimensioned panel that is manufactured from a half-inch material. However, it is to be understood that thinner or thicker materials can also be used, such as a ¼" to much thicker material. The sign panel 12 is one of a material selected from the following: plywood, a composite such as aluminum skinned plastic and a high pressure laminate (HPL), which is an exterior grade product (e.g., resin and filler fused under heat and pressure into a rigid panel), i.e., similar to Formica®. Preferably, the sign panel 12 is configured from a HPL, with image data digitally printed and impregnated into the face of the material sandwich or HPL surface with reflective vinyl graphics being applied to the surface.

Figure 2:
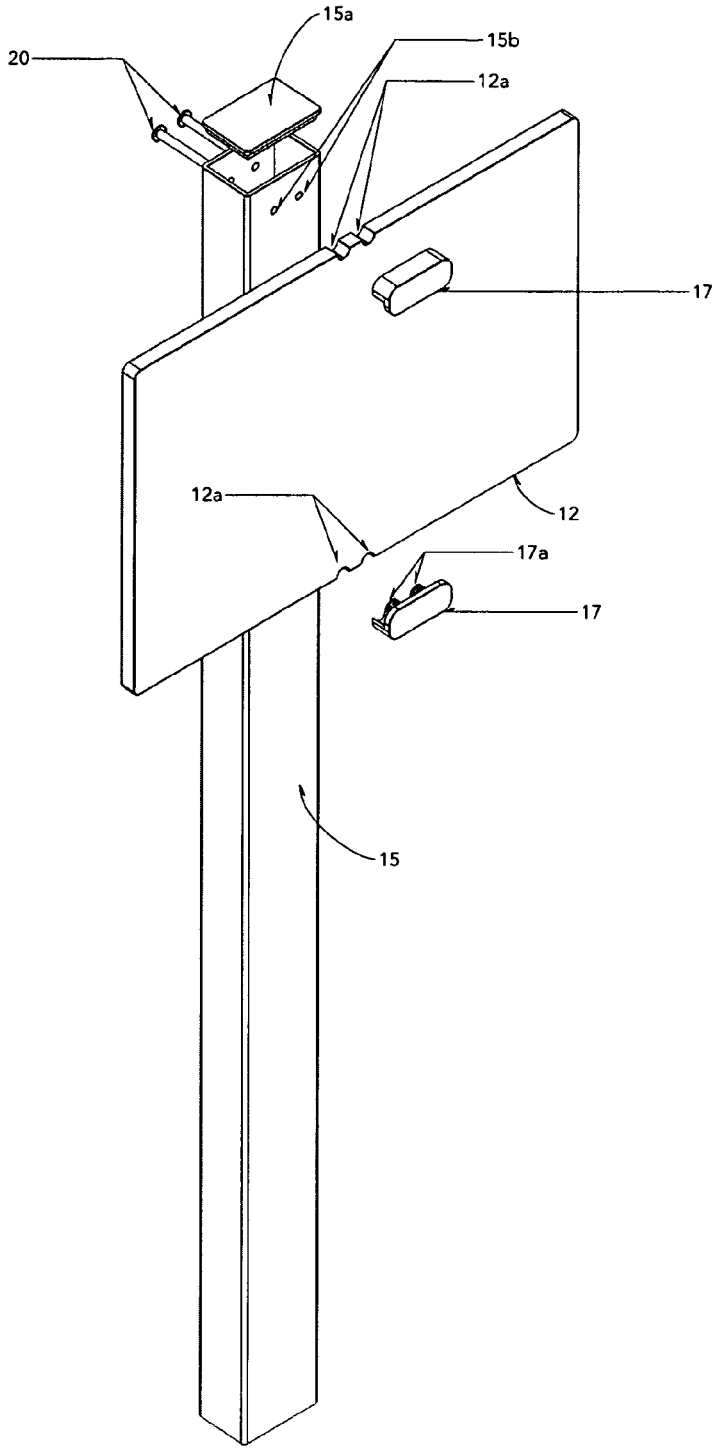
FIG. 2 is an illustration of an exploded perspective view of the sign of FIG. 1.

FIG. 2 is an illustration of an exploded perspective view of the sign system of FIG. 1. Here, the sign post 15 is shown with a cap 15*a* that fits into the upper end of a tubular sign post in a corresponding manner by a friction fit. Instead of a friction fit, however, any suitable attachment means may also be used, such as adhesives, welding and mechanical fasteners. In addition, cap 15*a* may also be formed integrally with vertical upright 15 instead of being a separate piece. The sign post shown in FIG. 2 is hollow and is depicted as being substantially square in cross-section. However, the sign post may have any cross-sectional shape. Moreover, it should be understood that it is also possible for the post to be made from a solid material of suitable strength, including wood (e.g., dimensional lumber), plastics, or metals, such as aluminum, steels, metal alloys, and other high strength compounds and composites. It should be noted that a solid post, such as wood, does not require a cap, but may appropriately receive a cover to prevent end grain rot which is common to unprotected wood products.

As further shown in FIG. 2, the sign panel 12 is provided with keyed indentations 12*a* that are located at the top and bottom edges of the panel to permit capture and rigid securement of the sign panel 12 by a pair of retaining buttons 17. In embodiments where the sign panel 12 is used with single post assemblies, the keyed indentations 12*a* are located at a centered position on the sign panel 12. In alternative embodiments, the keyed indentations 12*a* are located at a predefined offset. In embodiments where the sign panel is used with double post assemblies, however, the keyed indentations are placed at desired positions located outwardly toward the vertical edges of the sign panel 12. In addition, although indentations that are based on arced features are shown, it is also contemplated that different shapes for the keyed indentations may be implemented, such as squares, angled indentations such as triangles or as a single trough.

As stated above, the pair of retaining buttons 17 are used to anchor the sign panel 12 to the sign post 15. Each retaining button 17 is provided with at least one protrusion 17*a* that corresponds in shape and configuration to the keyed indentation 12*a* of the sign panel 12. As a result, when the top or bottom retaining button 17 is fixedly attached to the sign post 15, and the at least one protrusion 17*a* of the retaining button is engaged and seated in the keyed indentation 12*a* of the sign panel 12, the sign panel 12 becomes locked in place so that there is no room for lateral movement or removal of the panel. As a result, the lateral sliding of the sign panel to improperly remove it is prevented. Each retaining button 17 is manufactured from a durable material, for example, a machined or cast metal fitting, such as aluminum, which includes the keyed protrusions 17*a*. In addition, the face of the retaining button 17 is manufactured in a shape that is symmetrical along its central axis. As a result, a universal button is achieved that may be used at either the upper or lower edges of the sign panel 17.

FIG. 2 shows dual attachment bolts 20 for attaching the sign panel to the sign post 15, which can eliminate the chance that the sign panel 12 will not be perpendicular to the post 15 when attached. Alternatively, however, it should be clearly understood that an embodiment in which a retaining button 17 utilizing a single bolt to fixedly attach the retaining button to sign post 15 is also appropriate, and it is not the intention to limit the present contemplated embodiments to a dual attachment bolt construction.

Figure 3A:
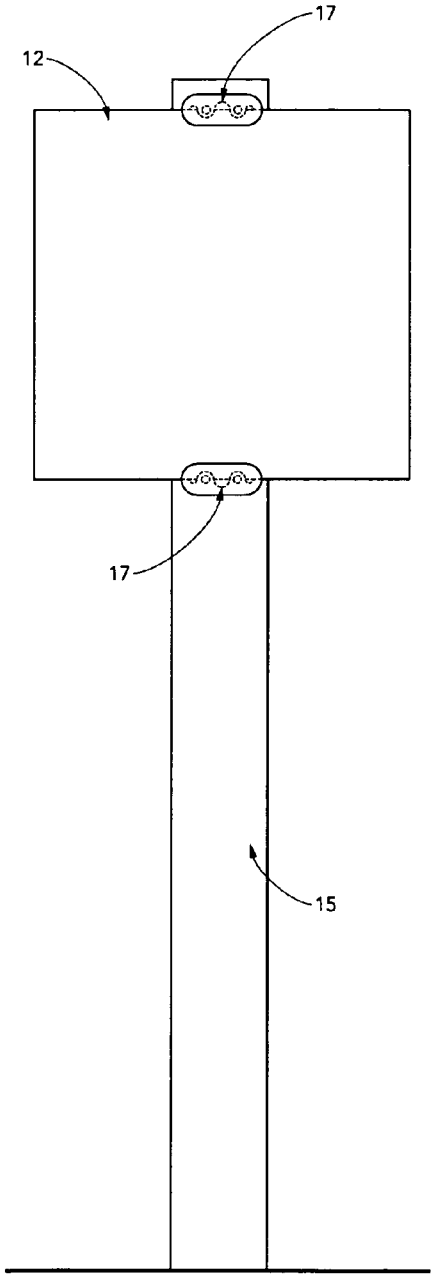
FIGS. 3(*a*) and 3(*b*) are illustrations of a front view and a cross sectional view of the sign of FIG. 1.
Figure 3B:
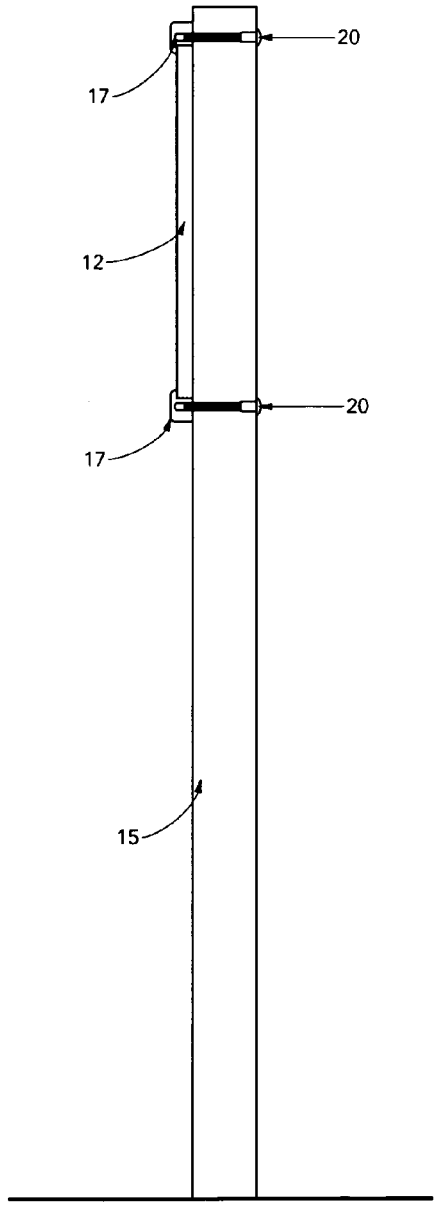

FIGS. 3(*a*) and 3(*b*) are illustrations of a front view and a cross sectional view of the sign of FIG. 1. As shown therein, the single face assembly for a single panel is anchored to the post using attachment bolt 20 inserted from the back face of the post through holes 15*b* (FIG. 2) and into internally machined threaded holes (not shown) located at the rear of the retaining button 17. In accordance with the contemplated embodiment, the attachment bolt 20 is unexposed at the front face of the retaining button 17. By providing such a "finished face" on the retaining button 17, the area of the positive capture or retention of the panel is minimized to allow substantially full use of panel 12 for the application of graphics. In accordance with the contemplated embodiments, the retaining button 17 eliminates the need for through bolts that penetrate and deface a sign panel and cause premature failure around the attachment point as the bolt is torqued to secure the panel to the post. Here, the depth of the retaining button 17 is set equal to the thickness of the sign panel 15, and full attachment with bolts 20 secures the panel, but does not compress the area surrounding the point of attachment. In addition, the width of the capture area on the retaining button 17 mitigates lateral twisting of panel that is common to conventional bolt attachment.

Figure 4:
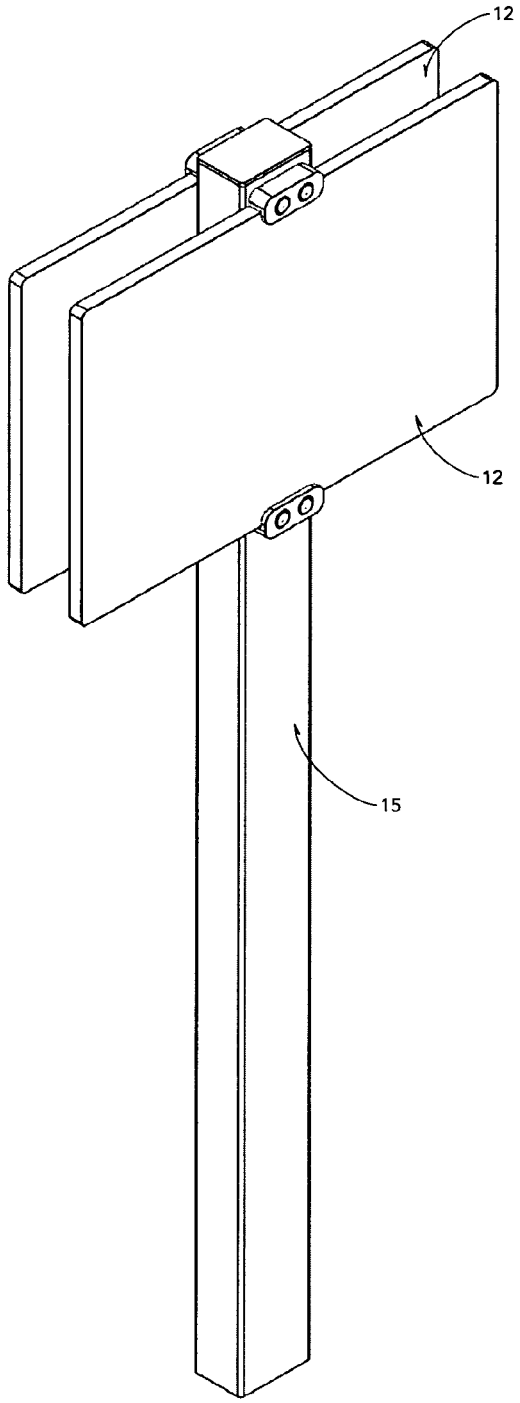
FIG. 4 is an illustration of a perspective view of a sign in accordance with an alternative embodiment of the invention.
Figure 5:
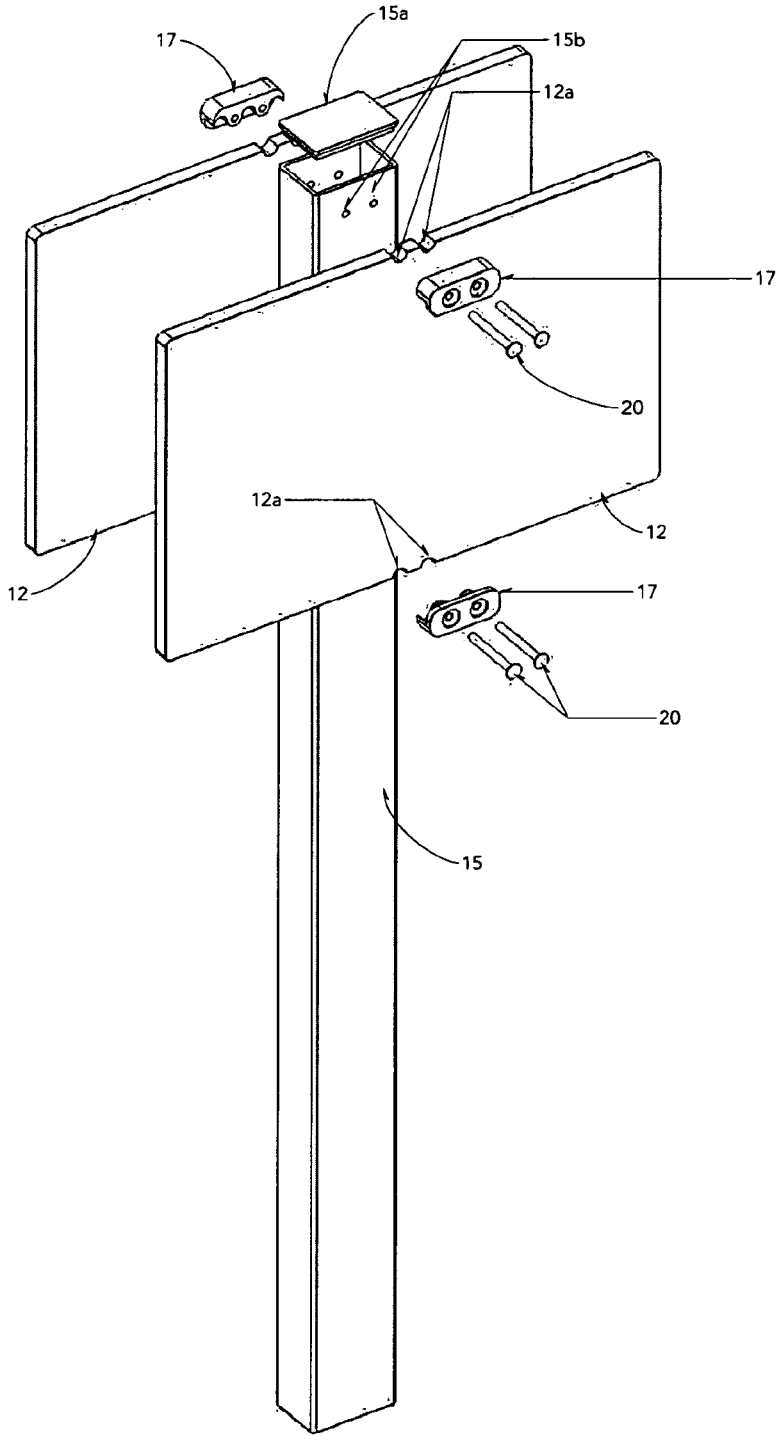
FIG. 5 is an illustration of an exploded perspective view of the sign of FIG. 4.

FIG. 4 is an illustration of a perspective view of a sign system in accordance with an alternative embodiment of the invention. Here, a sign panel 12 is mounted on both the front and rear faces of the sign post 15 to create a double face sign assembly. FIG. 5 is an illustration of an exploded perspective view of the double face sign system of FIG. 4. As shown therein, each sign panel 12 is attached to the sign post 15 using attachment bolts 20 inserted through holes in a modified retaining button 17 and the holes 15*b* of the post and into internally machined holes (not shown) located in the rear retaining button 17. It is to be readily understood that various types of attachment bolts may be used. In accordance with the contemplated embodiment, one type of bolt attachment comprises a single threaded bolt having a low profile head with hex key or similar tamper resistant head that engages with a corresponding counter bore on the modified retaining button 17. It is also to be readily understood that other types of fastening systems may be used. In the present contemplated embodiment, each attachment bolt 20 is similarly unexposed at the front face of the retaining button 17. By providing such a "finished face" on the retaining button 17, the area of the positive capture or retention of the panel is minimized to allow substantially full use of panel 12 for application of graphics. In accordance with the contemplated embodiments, the retaining button 17 eliminates the need for through bolts that penetrate and deface a sign panel and cause premature failure around the attachment point as the bolt is torqued to secure the panel to the post. Here, the depth of retaining button 17 is set equal to the thickness of the sign panel 12, and full attachment with bolts 20 secures the panel, but does not compress the area surrounding the point of attachment. The width of the capture area on the retaining button 17 mitigates lateral twisting of the panel in a manner that is common to conventional bolt attachment arrangements.

Figure 6A:
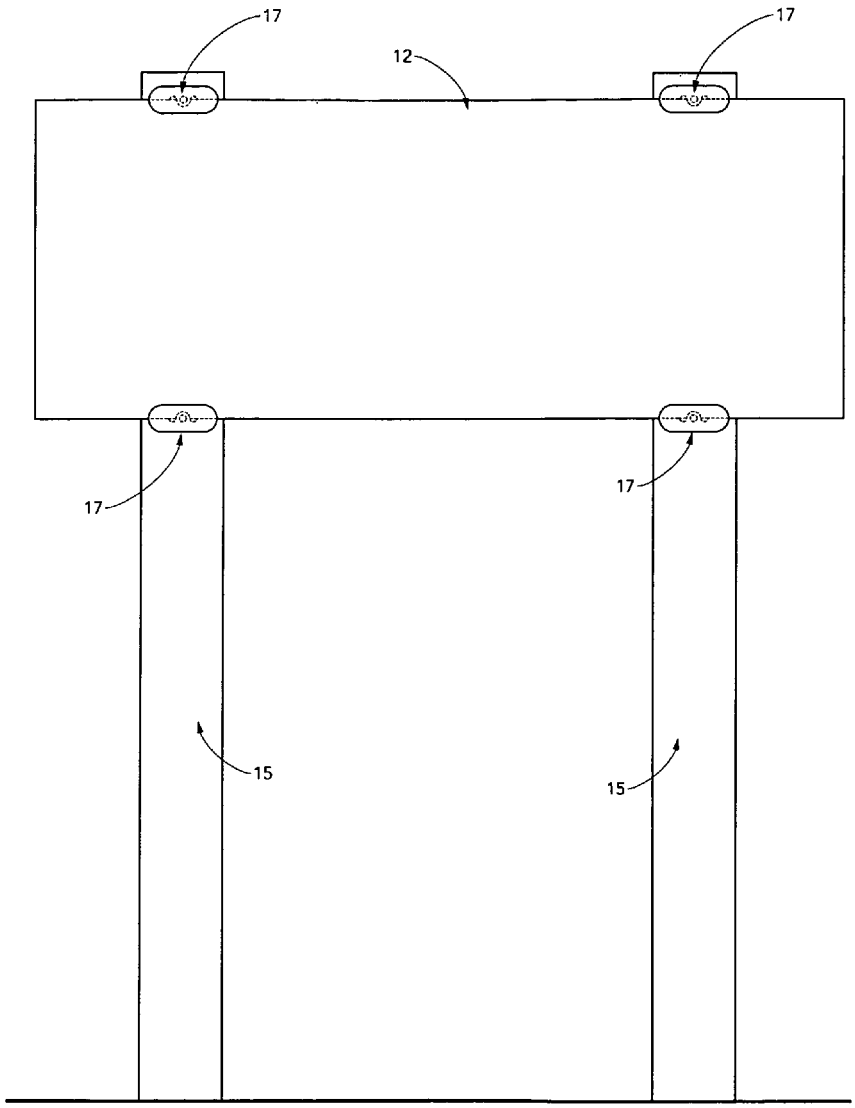
FIGS. 6(*a*) and 6(*b*) are illustrations of a front view and a cross sectional view of the sign in accordance with another embodiment of the invention.
Figure 6B:
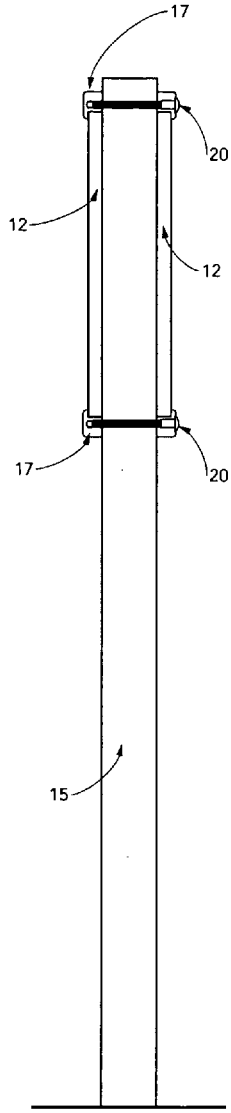

FIGS. 6(*a*) and 6(*b*) are illustrations of a front view and a cross sectional view of a sign system in accordance with another embodiment of the invention. Here, double sign posts are used to provide support for wider sign panels 12. As shown therein, each sign panel 12 is attached to the sign post 15 using attachment bolts 20 inserted through holes in a retaining button 17 and the holes 15*b* (not shown) of the post into internally machined holes (not shown) located in the rear retaining button 17.

The cross sectional view of the double post assembly shows a sign panel 12 mounted on the front and rear faces of the sign posts 15. However, in accordance with the disclosed embodiments, it is also possible to mount a sign panel only on a single side of the post. In addition, a single bolt retaining button 17 is also shown. However, in accordance with the disclosed alternative embodiments of the retaining button 17, a retaining button that receives dual bolts may also be implemented to secure the sign panels to the posts.

Similarly, the wide panel 12 is provided with keyed indentations (not shown) that are located at the top and bottom edges of the panel to permit capture and securement of the sign panel 12 to each post 15 by a respective pair of retaining buttons 17 that are placed above and below the panel and are fixedly attached to the post 15 with attachment bolts 20. As will be apparent from FIG. 6, the keyed indentations are placed at positions located outwardly toward the edges of the sign panel 12. It should be readily appreciated that the indentations are placed in a position to allow for common alignment of all panels, i.e., top to bottom and front to back alignment. In addition, although indentations that are based on arced features are shown, it is also contemplated that different shapes for the keyed indentations may be used, such as squares, angled indentations such as triangles, or a trough that provides full engagement between sign panel 12 and corresponding retaining button 17.

Figure 7A:
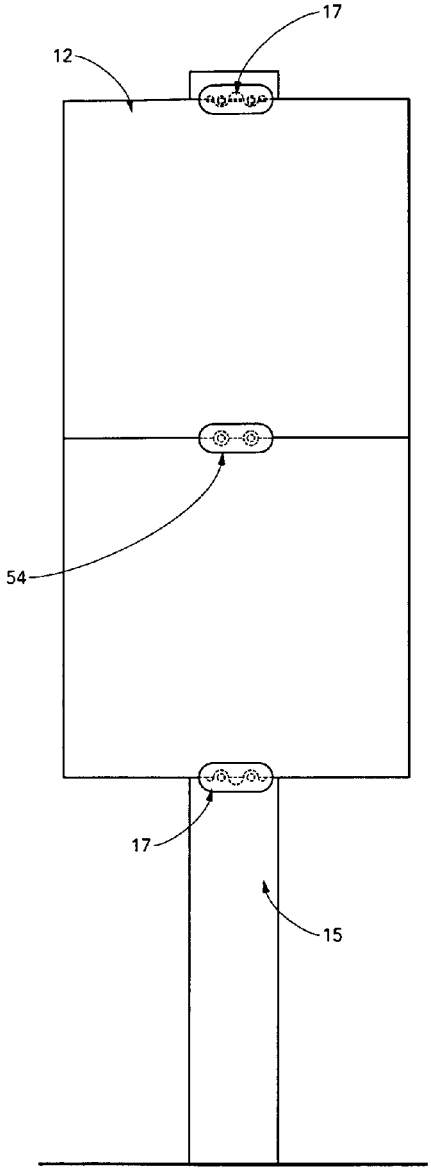
FIGS. 7(*a*) and 7(*b*) are illustrations of a front view and a cross sectional view of the sign in accordance with another embodiment of the invention.
Figure 7B:
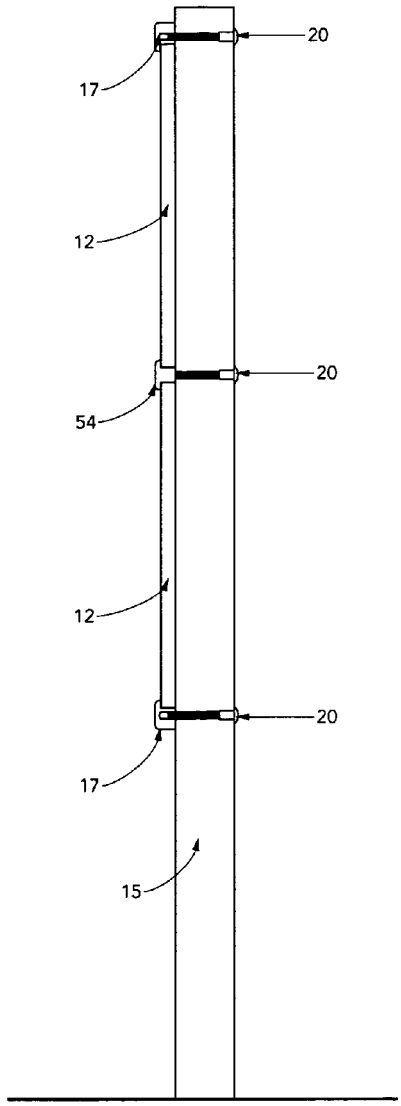
Figure 8A:
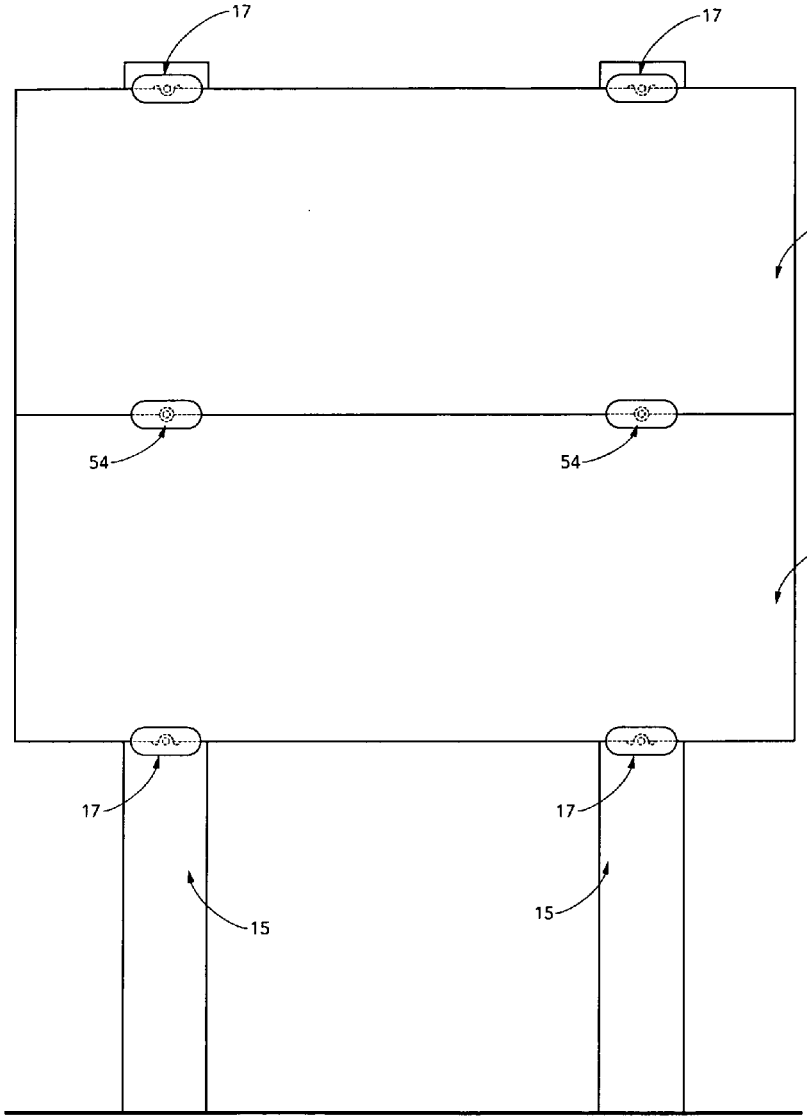
FIGS. 8(*a*) and 8(*b*) are illustrations of a front view and a cross sectional view of the sign in accordance with an alternative embodiment of the invention.
Figure 8B:
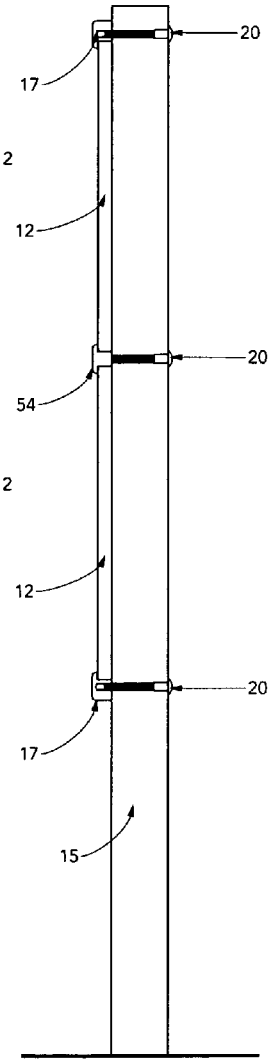

FIGS. 7(*a*) and 7(*b*) are illustrations of a front view and a cross sectional view of the sign system in accordance with yet another embodiment of the invention. In accordance with this alternative embodiment, multiple sign panels are used to provide a larger display area or multiple messages on the same post. Here, the multiple sign panels 12 are shown arranged one on top of the other in a vertically stacked manner to provide a multi-panel assembly. In the present embodiment, the keyed indentations in the middle of a two panel assembly are identical to those of the indentations in the top of the top panel and bottom of the bottom panel. FIGS. 8(*a*) and 8(*b*) are illustrations of a front view and a cross sectional view of the sign system in accordance with an alternative embodiment of such a multi-panel assembly. In FIGS. 8(*a*) and 8(*b*), however, the sign panels 12 are shown mounted in a wide, dual post configuration.

In either of the embodiments shown in FIGS. 7(*a*) and (*b*) and FIGS. 8(*a*) and (*b*), the center retaining button 54 is an embodiment of the retaining button that permits the simultaneous capture, retention and securement of both the upper and lower panels 12, similarly to the capture and retention of the sign panel when used in a single panel configuration. In the present contemplated embodiments, the keyed indentations in the middle of a two panel assembly are identical to those of the indentations in the top of the top panel and bottom of the bottom panel.

Retaining buttons that receive dual bolts 20 are shown in FIGS. 7(*a*) and 7(*b*). Retaining buttons 17 that receive a single bolt are shown in the alternative embodiment of the sign system shown in FIGS. 8(*a*) and 8(*b*). Naturally, it will be appreciated that the dual bolt or single bolt retaining buttons shown in FIGS. 7(*a*) and 7(*b*) and FIGS. 8(*a*) and 8(*b*) are interchangeable, and that either single bolt or dual bolt retaining buttons may be used in either of the two presently contemplated embodiments.

Figure 9A:
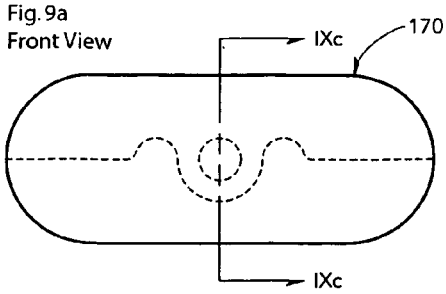
FIGS. 9(*a*), 9(*b*) and 9(*c*) are illustrations of a front, rear and cross sectional side view of a single retainer button in accordance with the invention.
Figure 9B:
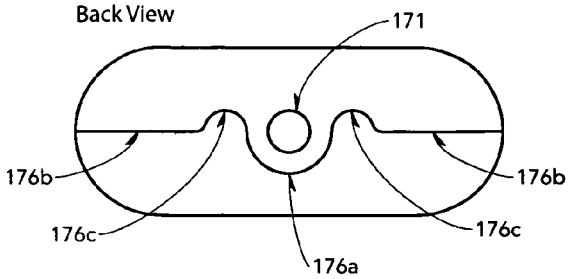
Figure 9C:
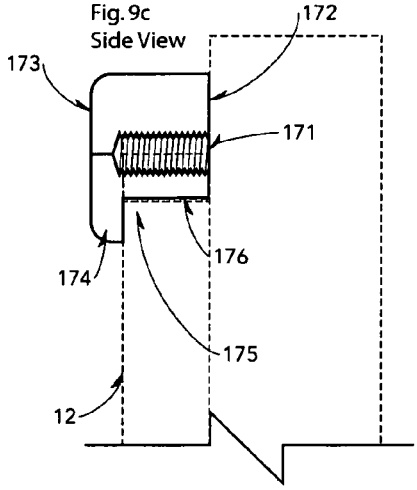

Even though the retaining buttons of FIGS. 7(*a*) and 7(*b*) and FIGS. 8(*a*) and 8(*b*) are interchangeable, the present invention contemplates embodiments in which application specific retaining buttons are required. One embodiment of such a retaining button is illustrated in FIGS. 9(*a*)-9(*c*). Here, a front view, a back view and a side view of a button 170 are shown, which may be used as retaining button 17 in FIGS. 6(*a*) and 6(*b*) or FIGS. 8(*a*) and 8(*b*). With reference to the side view of FIG. 9(*c*), the retaining button 170 has a rear face 172 and a front face 173. A threaded hole 171 that threadably receives a bolt for anchoring a sign panel to a sign post is open to the rear face 172. The retaining button 170 includes a retaining element 174 that projects from the front face in a direction substantially perpendicular to the threaded hole 171. The retaining button 170 also has a surface 176 that extends in a direction parallel to the orientation of the threaded hole between the retaining element 174 and the rear face 172. As a result, a space 175 is formed by the retaining element 174 and the surface 176 for engaging and receiving an edge of the sign panel 12. FIG. 9(*c*) shows the top edge of the sign panel 12 received in space 175. However, the retaining button 170 is merely turned upside down to receive a bottom edge of the panel.

Figure 17A:
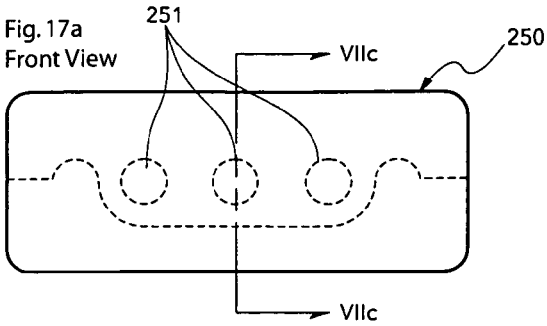
FIGS. 17(*a*), 17(*b*), 17(*c*) and 17(*d*) are illustrations of a front, rear, cross sectional side view and an implementation of a single or dual retainer button in accordance with an alternative embodiment of invention.
Figure 17C:
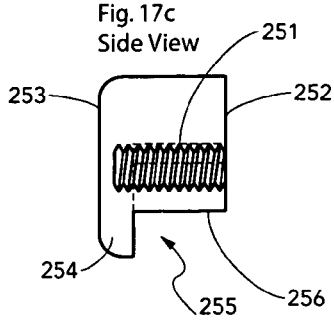
Figure 17B:
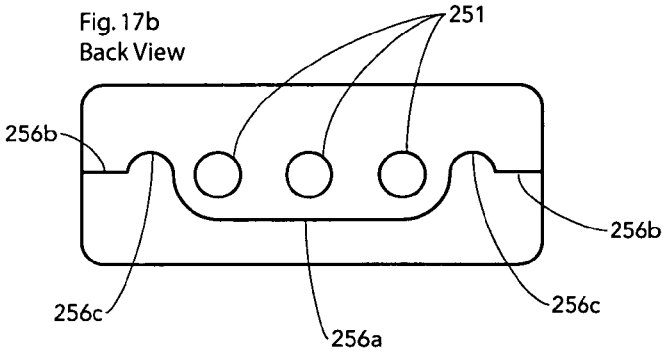
Figure 17D:
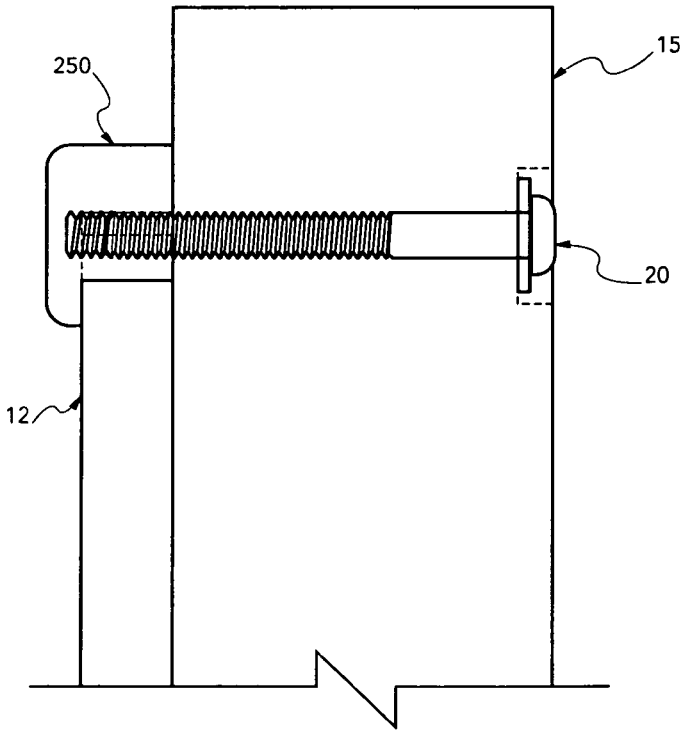
Figure 18A:
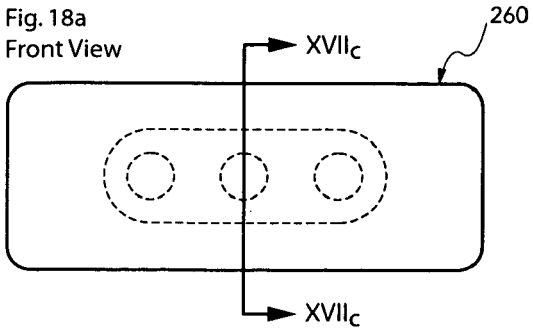
FIGS. 18(*a*), 18(*b*), 18(*c*), and 18(*d*) are illustrations of a front, rear, cross sectional side view and an implementation of a single or dual retainer button in accordance with another embodiment of the invention.
Figure 18C:
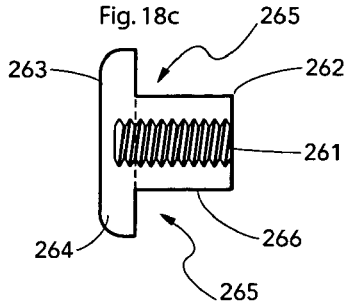
Figure 18B:
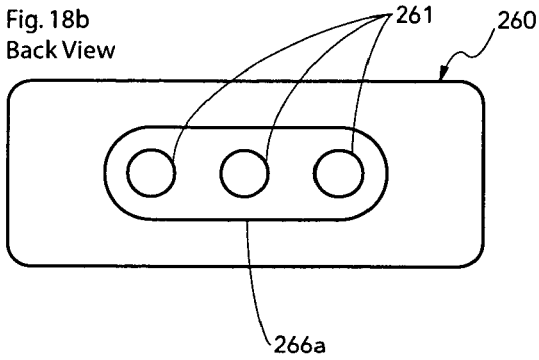
Figure 18D:
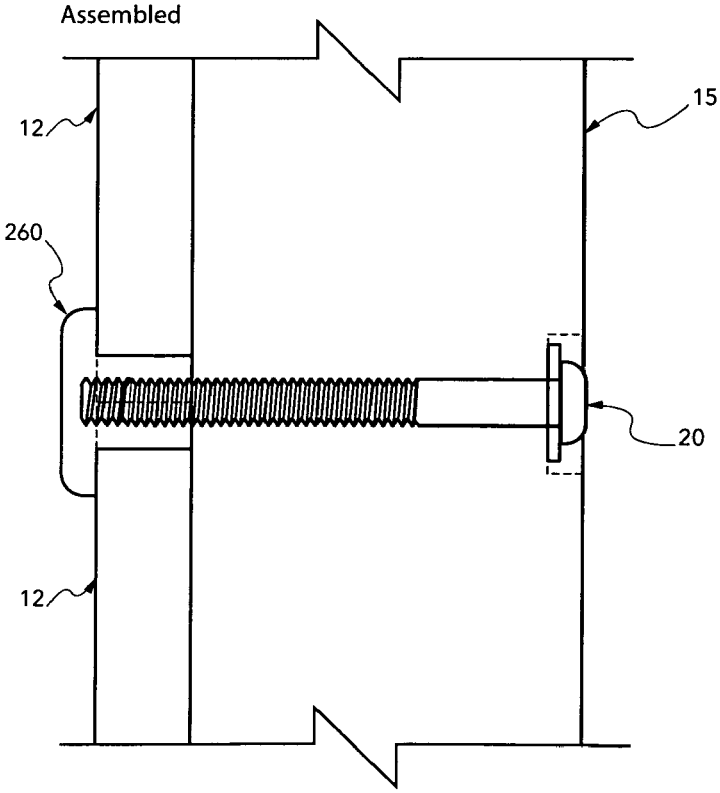
Figure 19A:
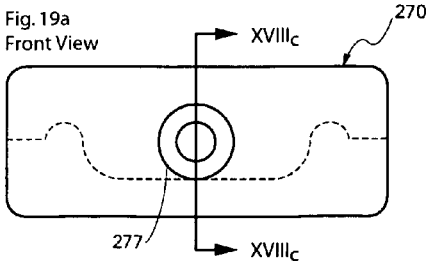
FIGS. 19(*a*), 19(*b*), 19(*c*), 19(*d*) and 19(*e*) are illustrations of a front, rear, cross sectional side view, an implementation and an alternative implementation of a single retainer button in accordance with an additional alternative embodiment of the invention.
Figure 19C:
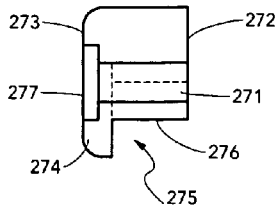
Figure 19B:
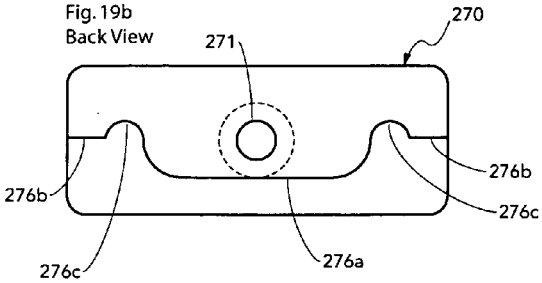
Figure 19D:
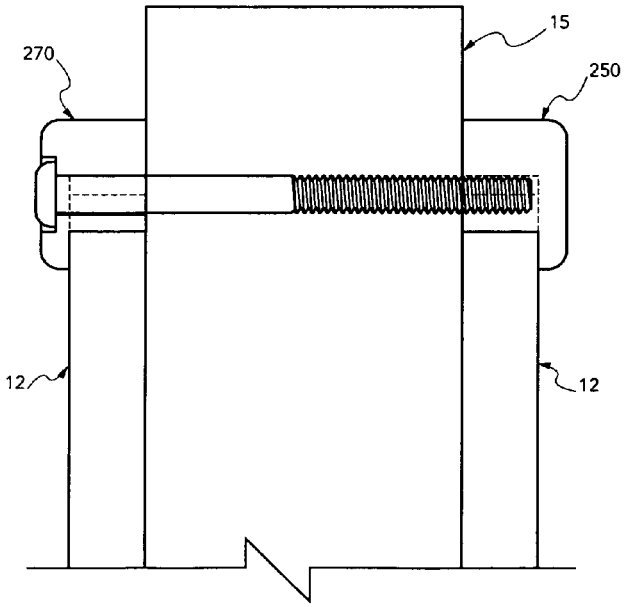
Figure 19E:
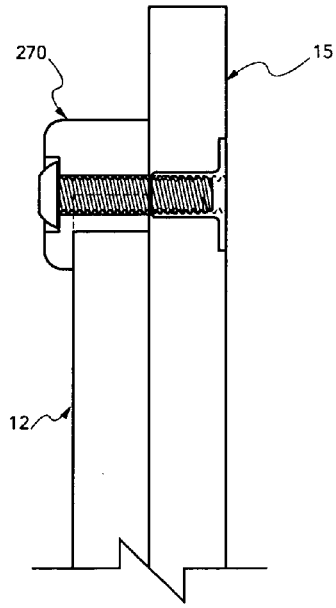
Figure 20A:
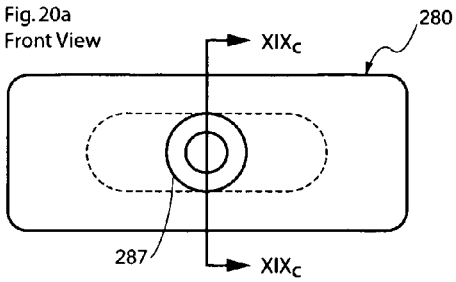
FIGS. 20(*a*), 20(*b*), 20(*c*), 20(*d*) and 20(*e*) are illustrations of a front, rear, cross sectional side view, an implementation and an alternative implementation of a single retainer button in accordance with an additional alternative embodiment of the invention.
Figure 20C:
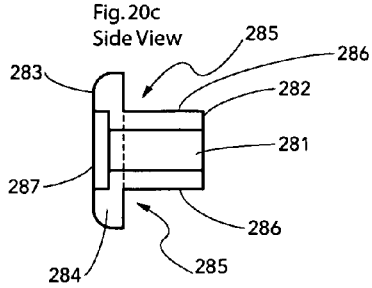
Figure 20B:
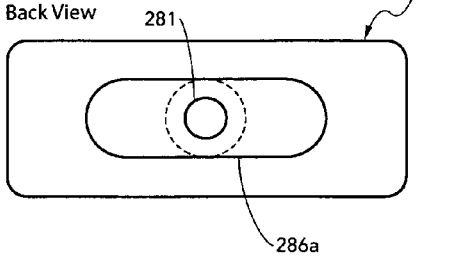
Figure 20D:
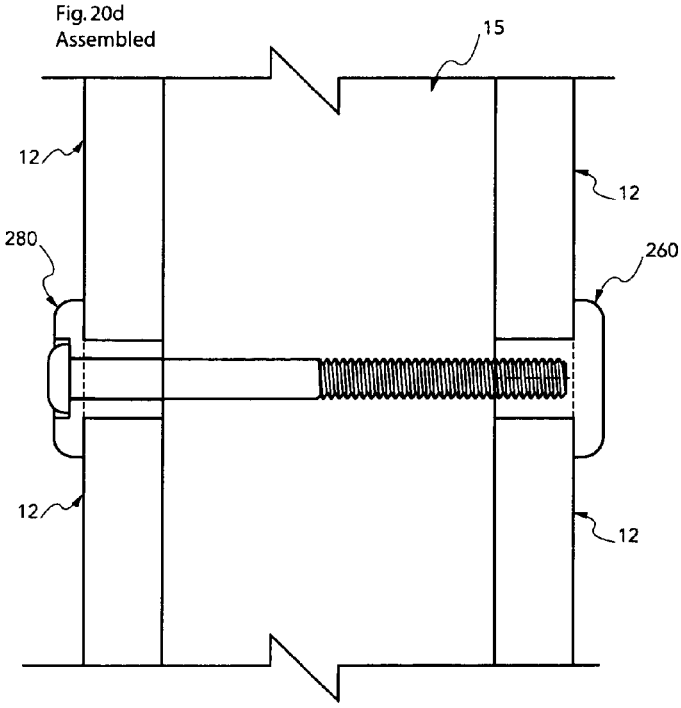
Figure 20E:
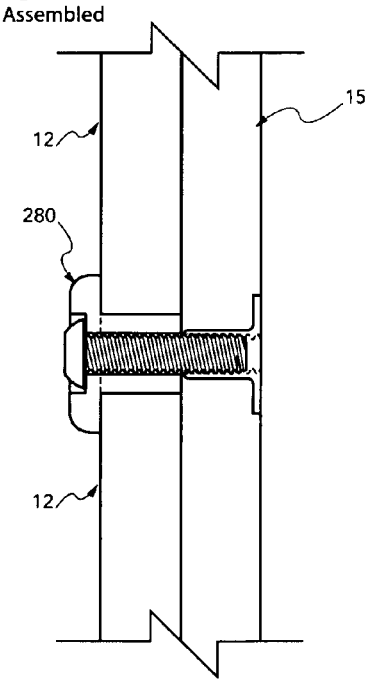
Figure 21A:
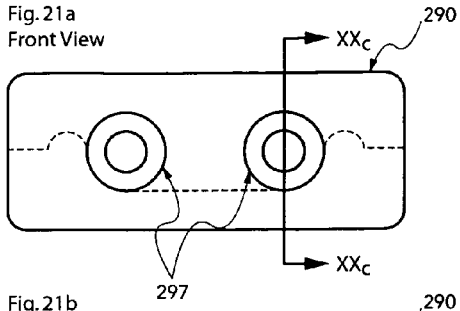
FIGS. 21(*a*), 21(*b*), 21(*c*) and 21(*d*) and 21(*e*) are illustrations of a front, rear, cross sectional side view, an implementation and an alternative implementation of a dual retainer button in accordance with an alternative embodiment of the invention.
Figure 21C:
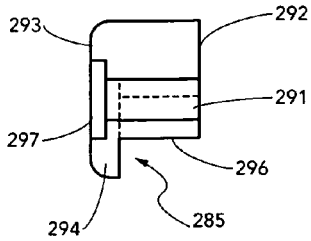
Figure 21B:
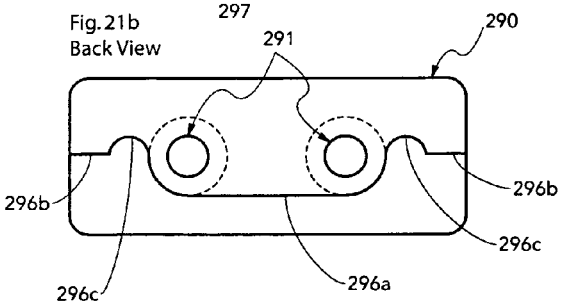
Figure 21D:
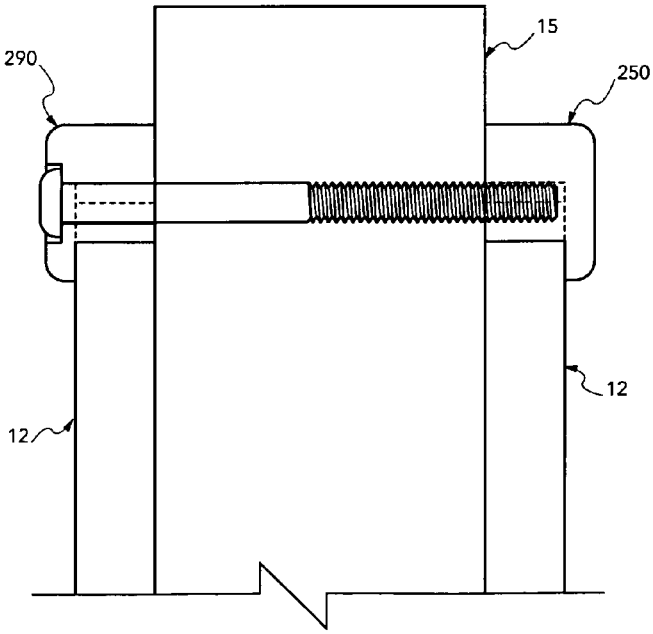
Figure 21E:
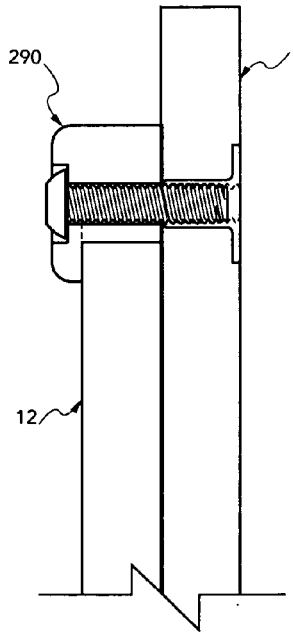
Figure 22A:
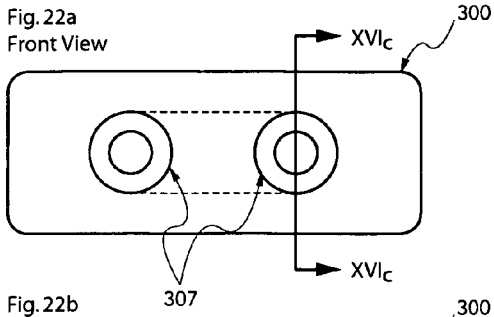
FIGS. 22(*a*), 22(*b*) and 22(*c*) are illustrations of a front, rear and cross sectional side view of a dual retainer button in accordance with an additional alternative embodiment of the invention.
Figure 22C:
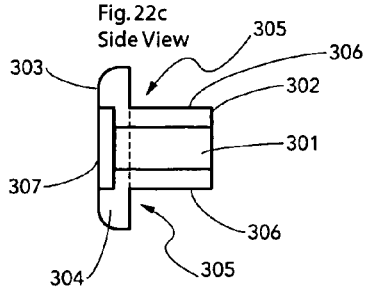
Figure 22B:
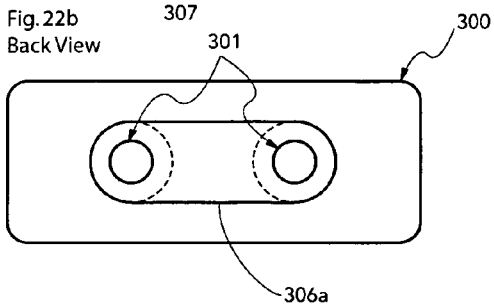
Figure 22D:
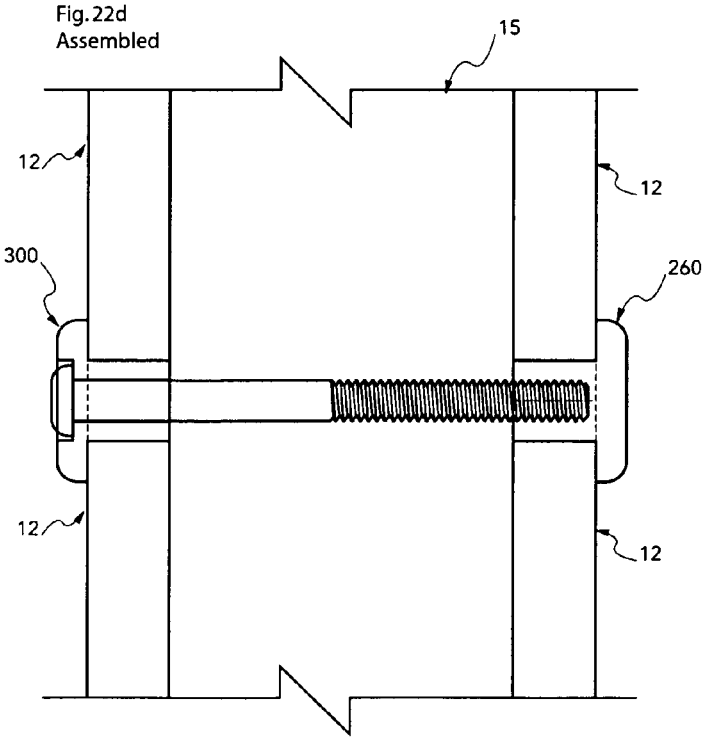
Figure 22E:
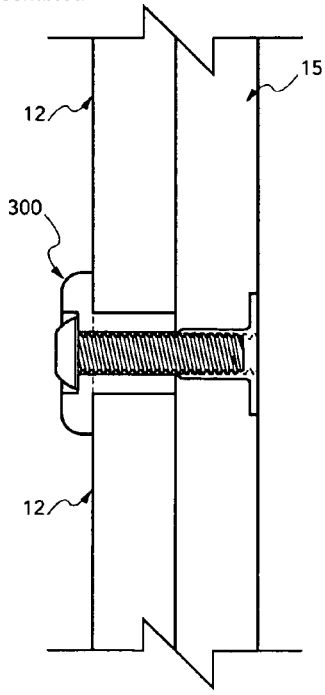

In the front view shown in FIG. 9(*a*), the front face 173 of the retaining button 170 is finished continuous, smooth or flat, or with a surface finish or shape that does not impede the function of the retainer button. The threaded hole 171 is a blind hole so that the single bolt for holding the retaining button 170 to the sign post does not extend completely through the retaining button. By providing the finished face on the retaining button, the surface of a sign panel remains uncompromised when the retaining button is installed to attach the sign panel on the sign post (see FIG. 17*d*)).

With reference to FIG. 9(*b*), the back view of the retaining button 170 in accordance with the present embodiment shows the surface 176 between the retaining element 174 and the rear surface 172 includes a protrusion 176*a* that corresponds in shape and configuration to the keyed indentation located at the edges of the sign panel 12. The protrusion 176*a* comprises a semi-circular surface that is circumferentially arranged around the centrally located threaded hole 171 that receives the bolt. In addition, a pair of indentations 176*c* is arranged at either side of the semi-circular surface formed around the threaded hole. Finally, the surface 176 includes a substantially planar area 176*b* that rests against the flat portion of the edge of the sign panel received in the space 175. An exemplary implementation of the retaining button 170 of FIGS. 9(*a*), 9(*b*) and 9(*c*) is in the sign post configuration shown in FIGS. 6 and 8.

Figure 10A:
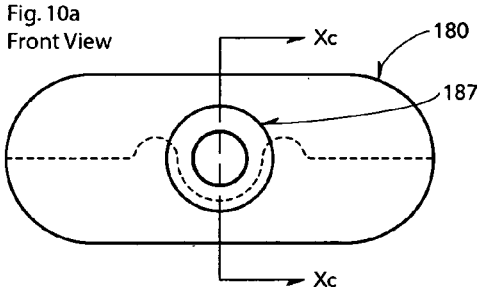
FIGS. 10(*a*), 10(*b*) and 10(*c*) are illustrations of a front, rear and cross sectional side view of a single retainer button in accordance with an alternative embodiment of the invention.
Figure 10B:
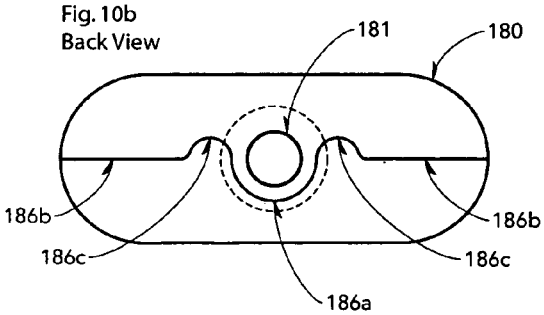
Figure 10C:
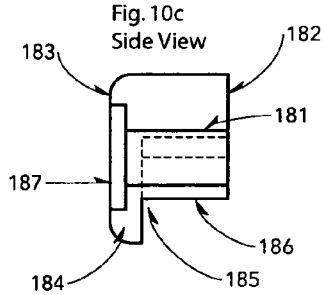

FIGS. 10(*a*), 10(*b*) and 10(*c*) show another embodiment of a retaining button 180 of the single bolt configuration. Here, a front view, a back view and a side view of the retaining button 180 are shown. With reference to the side view of FIG. 10(*c*), which is a cross sectional view of the retaining button along line $X_c$-$X_c$ in FIG. 10(*a*), the retaining button 180 has a rear face 182 and a front face 183. A through-hole 181 that receives a bolt for anchoring a sign panel to a sign post extends completely through the retaining button 180. The retaining button includes a retaining element 184 that projects from the front face 183 in a direction substantially perpendicularly to the through-hole 181. The retaining button 180 also has a surface 186 that extends in a direction essentially parallel to the orientation of the through-hole 181 between the retaining element 184 and the rear face 182. As a result, a space 185 is formed by the retaining element 184 and the surface 186 that engages and receives an edge of the sign panel 12. The retaining button also includes a counter-bored region 187 at the front face 183 that permits a bolt head to sit flush with the front face surface of the retaining button 180. The retaining button 180 is complementary to retaining button 170 in that one bolt 20 can be inserted through the retaining button 180 on one side of a sign post and threadably received in the retaining button 170 arranged on an opposing side of the sign post to hold both retaining buttons 170, 180 in place (see FIG. 6(*b*)). However, it is also possible to utilize retaining button 180 alone to secure the sign panel, where the head of the bolt would rest in the counter-bored recess disposed around the through-hole and a nut or threaded hole in the sign post receives the bolt.

With reference to FIG. 10(*b*), the back view of the retaining button 180 in accordance with the present embodiment shows the surface 186 between the retaining element and the rear face 182 includes a protrusion 186*a* that corresponds in shape and configuration to the keyed indentation located at the edges of the sign panel 12. The protrusion 186*a* comprises a semi-circular surface that is circumferentially arranged around the centrally located through-hole through which the bolt extends completely through. In addition, a pair of indentations 186*c* is arranged at either side of the semi-circular surface formed around the through-hole 181. Finally, the surface 186 includes a substantially planar area 186*b* that rests against the flat portion of the edge of the sign panel received in the space 185. An exemplary implementation of the retaining button of FIGS. 10(*a*), 10(*b*) and 10(*c*) is in the sign post configuration shown in FIGS. 6(*a*) and 6(*b*), but in a single bolt configuration.

Figure 11A:
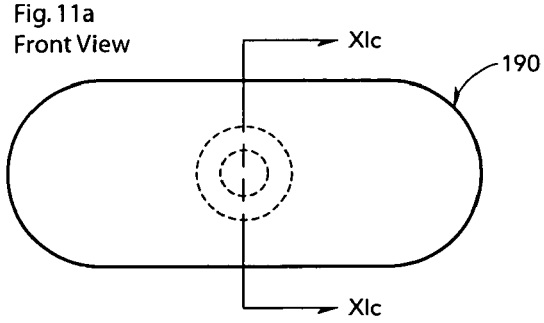
FIGS. 11(*a*), 11(*b*) and 11(*c*) are illustrations of a front, rear and cross sectional side view of a single retainer button in accordance with another alternative embodiment of the invention.
Figure 11C:
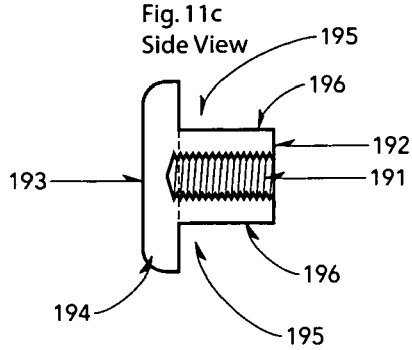
Figure 11B:
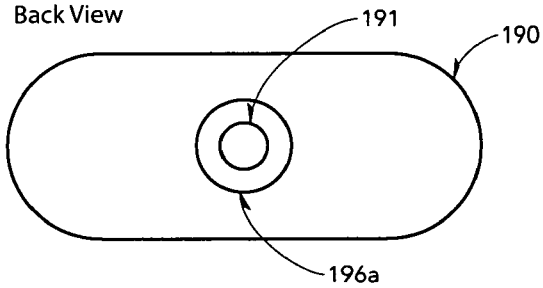

FIGS. 11(*a*), 11(*b*) and 11(*c*) show another embodiment of a retaining button 190 of the single bolt configuration. Here, a front view, a back view and a side view of the retaining button 190 are shown. With reference to the side view of FIG. 11(*c*), retaining button 190 includes a rear face 192 and a front face 193. A threaded hole 191 located within a cylindrical protrusion that threadably receives a bolt for anchoring a sign panel to a sign post is open to the rear face 192. Hole 191 is blind so that the single bolt does not extend completely through the retaining button 190. The front view of FIG. 11(*a*) shows that the front face 193 of the retaining button 190 of this contemplated embodiment is also finished continuous, smooth or flat or with a surface finish or shape that does not impede the function of the retainer button.

With additional reference to FIG. 11(*b*), the back view of the retaining button 190 in accordance with the present embodiment shows the location of the cylindrical protrusion about which a cylindrical surface 196 extends. When the rear face 192 abuts a sign post, a space 195 is defined between the flanged head 194 and the sign post for receiving opposing edges of two adjacent panels, as shown in FIGS. 7(*a*) and 7(*b*). The dashed circular line shown in the front view indicates the circumference of the threaded hole 191 and the cylindrical protrusion 196. It will be readily appreciated that the retaining button 190 of the current contemplated embodiment can be used in multi-panel sign systems as the center retaining button of the display (see FIGS. 8(*a*) and 8(*b*)). An exemplary implementation of the retaining button of FIGS. 11(*a*), 11(*b*) and 11(*c*) is in the sign post configuration shown in FIG. 8, i.e., as a center retaining button of a multi-panel assembly.

Figure 12A:
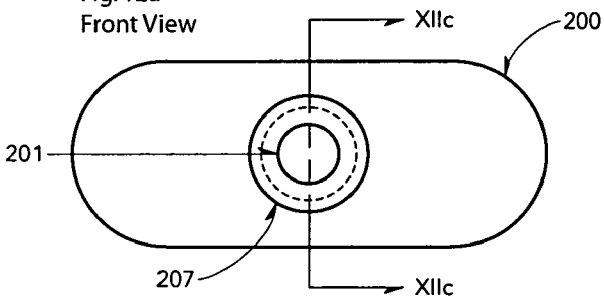
FIGS. 12(*a*), 12(*b*) and 12(*c*) are illustrations of a front, rear and cross sectional side view of a single retainer button in accordance with an additional alternative embodiment of the invention.
Figure 12C:
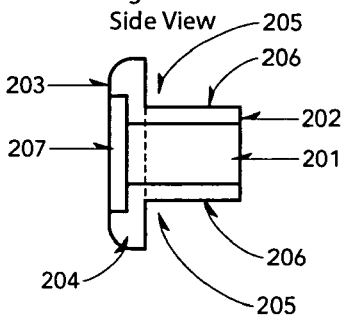
Figure 12B:
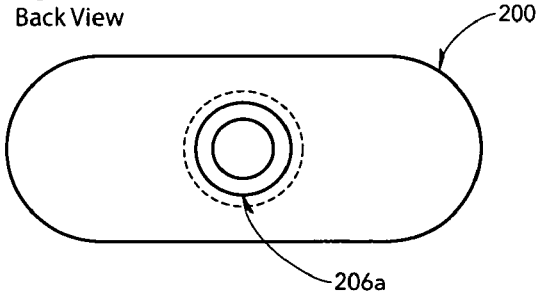

FIGS. 12(*a*), 12(*b*) and 12(*c*) show another embodiment of a retaining button 200 of the single bolt configuration. Here, a front view, a back view and a side view of the retaining button are shown. With reference to the side view of FIG. 12(*c*), which is a cross sectional view of the retaining button along line $XII_c$-$XII_c$ in FIG. 12(*a*), retaining button 200 has a rear face 202 and a front face 203. A through-hole 201 that receives a bolt for anchoring a sign panel to a sign post extends completely through the retaining button 200. The retaining button also includes a counter-bored region 207 that permits a bolt head to sit flush with the surface of the retaining button. The retaining button 200 is complementary to retaining button 190 in that one bolt 20 can be inserted through the retaining button 200 on one side of a sign post and threadably received in the retaining button 190 arranged on an opposing side of the sign post to hold both retaining buttons 190, 200 in place. However, it is also possible to utilize retaining button 200 at the front surface to secure the sign panel, where the head of the bolt would rest in the counter-bored region disposed around the through-hole and a nut or threaded hole in the sign post receives the bolt.

With specific reference to FIG. 12(*b*), the back view of the retaining button 200 in accordance with the present embodiment shows the location of the cylindrical protrusion about which a cylindrical surface 206 extends. When the rear face 202 abuts a sign post, a space 205 is defined between the flanged head 204 and the sign post for receiving edges of two adjacent panels, as shown in FIGS. 8(*a*) and 8(*b*). The dashed circular line shown in the front view of the retaining button indicates the outer circumference of the cylindrical protrusion. Finally, the dashed line shown in the back view indicates the outer circumference of the counter-bored region in the front face of the retaining button. An exemplary implementation of the retaining button of FIGS. 12(*a*), 12(*b*) and 12(*c*) is in the sign post configuration shown in FIG. 8, i.e., as a center retaining button of a multi-panel assembly, but in configurations having front and rear sign panels in the manner shown in FIG. 6.

Figure 13A:
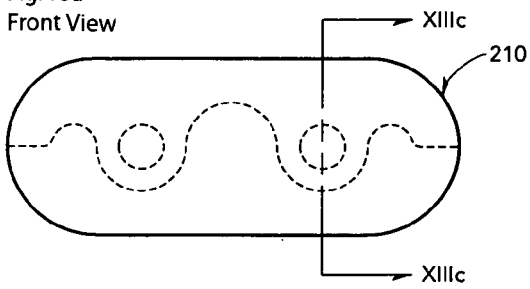
FIGS. 13(*a*), 13(*b*) and 13(*c*) are illustrations of a front, rear and cross sectional side view of a dual retainer button in accordance with the invention.
Figure 13B:
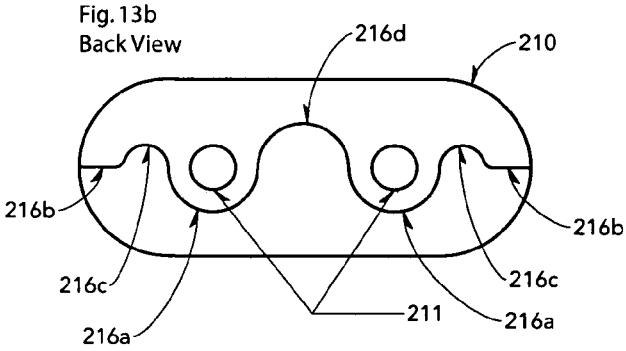
Figure 13C:
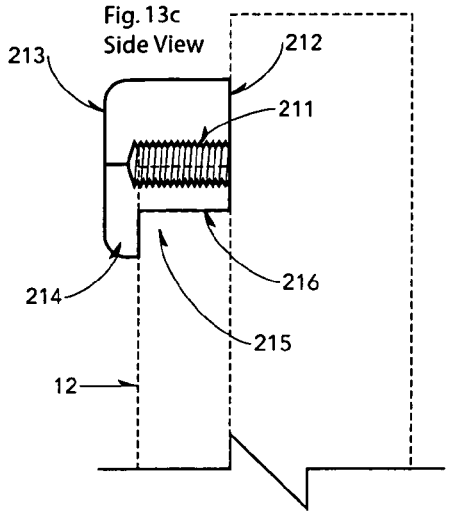

Another embodiment of a retaining button is illustrated in the dual bolt configuration shown in FIGS. 13(*a*), 13(*b*) and 13(*c*). Here, a front view, a back view and a sectional side view of the retaining button 210 are shown. With reference to the side view of FIG. 13(*c*), retaining button 210 has a rear face 212 and a front face 213. A pair of threaded holes 211 that threadably receive a respective bolt for anchoring a sign panel to a sign post are open to the rear face 212. The retaining button includes a retaining element 214 projects from the front face 213 in a direction substantially perpendicular to the threaded hole 211. The retaining button 210 also has a surface 216 that extends in a direction parallel to the orientation of the threaded hole between the retaining element 214 and the rear face 212. As a result, a space 215 is formed by the retaining element 214 and the surface 216 for engaging and receiving an edge of the sign panel 12. FIG. 13(*c*) shows the top edge of the sign panel 12 received in space 215. However, the retaining button 210 is merely turned upside down to receive a bottom edge of the panel.

FIG. 13(*a*) is the front view that shows the front face 213 of the retaining button 210 is finished continuous, smooth or flat or with a finish or shape that does not impede the function of the retainer button. Each threaded hole 211 is a blind hole so that each bolt for holding the sign panel to the sign post does not extend completely through the retaining button. By providing the finished face on the retaining button, the face of the overall assembly remains uncompromised when the retaining button is installed to attach the sign panel on the sign post.

As further shown in FIG. 13(*b*), the back view of the retaining button 210 in accordance with the present embodiment shows the surface 216 between the retaining element 214 and the rear surface 212 includes a pair of protrusions 216*a* that correspond in shape and configuration to the keyed indentation located at the edges of the sign panel 12. Each protrusion 216*a* comprises a semi-circular surface that is circumferentially arranged around a centrally located threaded hole 211 that each receive a bolt. In addition, a small indentation 216*c* is arranged at an outer side of each of the semi-circular surfaces formed around each of the threaded holes 211. A large semi-circular indentation 216*d* is arranged between the pair of semi-circular surfaces. Finally, the surface 216 includes substantially planar areas 216*b* that rest against the flat portion of the edge of the sign panel received in the space 215. An exemplary implementation of the retaining button of FIGS. 13(*a*), 13(*b*) and 13(*c*) is in the sign post configuration shown, for example, in FIGS. 1, 2 and 3.

Figure 14A:
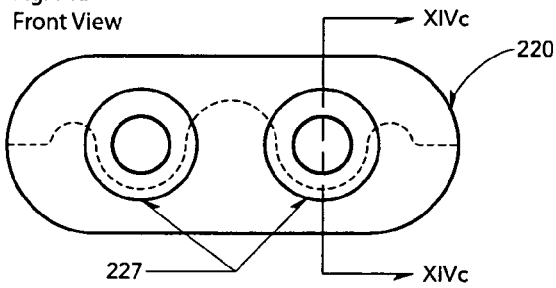
FIGS. 14(*a*), 14(*b*) and 14(*c*) are illustrations of a front, rear and cross sectional side view of a dual retainer button in accordance with an alternative embodiment of the invention.
Figure 14B:
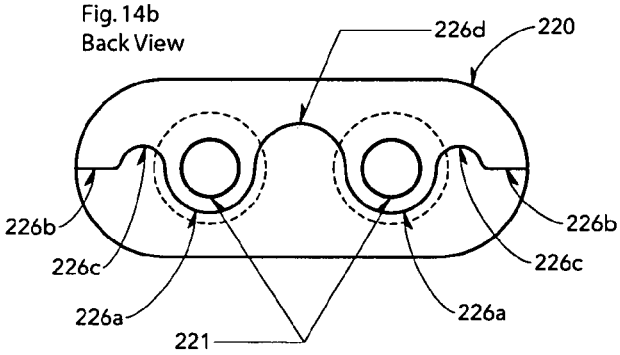
Figure 14C:
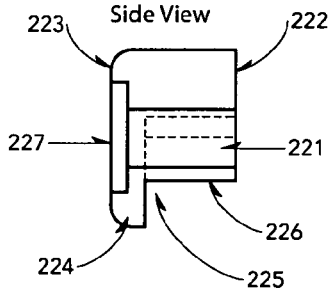

FIGS. 14(*a*), 14(*b*) and 14(*c*) show another embodiment of a retaining button 220 of the dual bolt configuration. Here, a front view, a back view and a side view of the retaining button 220 are shown. With reference to the side view of FIG. 14(*c*), which is a cross sectional view of the retaining button along line $XIV_c$-$XIV_c$ in FIG. 14(*a*), the retaining button 220 has a rear face 222 and a front face 223. A pair of through-holes 221 that receive a respective bolt for anchoring a sign panel to a sign post extend completely through the retaining button 220. The retaining button includes a retaining element 224 that projects from the front face 223 in a direction substantially perpendicularly to the through-hole 221. The retaining button 220 also has a surface 226 that extends in a direction essentially parallel to the orientation of the pair of through-holes 221 between the retaining element 224 and the rear face 222. As a result, a space 225 is formed by the retaining element 224 and the surface 226 that engages and receives an edge of the sign panel 12. The retaining button also includes a counter-bored region 227 at the front face 223 that permits a bolt head to sit flush with the front face surface of the retaining button 220. The retaining button 220 is complementary to retaining button 210 in that one bolt 20 can be inserted through the retaining button 210 on one side of a sign post and threadably received in the retaining button 210 arranged on an opposing side of the sign post to hold both retaining buttons 210, 220 in place. However, it is also possible to utilize retaining button 220 alone to secure the sign panel, where each head of a bolt would rest in the counter-bored recess disposed around a through-hole and nuts or threaded holes in the sign post to receive each bolt, respectively.

With reference to FIG. 14(*b*), the back view of the retaining button 220 in accordance with the present embodiment shows the surface 226 between the retaining element and the rear face 222 includes a pair of protrusions 226*a* that correspond in shape and configuration to the keyed indentation located at the edges of the sign panel 12. Each protrusion 226*a* comprises a semi-circular surface that is circumferentially arranged around the centrally located through-hole through which the bolt extends completely through. In addition, a small indentation 226*c* is arranged at either side of the semi-circular surface formed around each through-hole 221. A large semi-circular indentation 226*d* is arranged between the pair of semi-circular surfaces. Finally, the surface 226 includes a substantially planar area 226*b* that rests against the flat portion of the edge of the sign panel received in the space 225. An exemplary implementation of the retaining button of FIGS. 14(*a*), 14(*b*) and 14(*c*) is in the sign post configuration shown in FIG. 5.

Figure 15A:
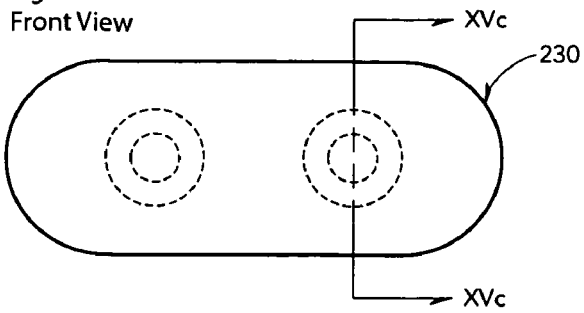
FIGS. 15(*a*), 15(*b*) and 15(*c*) are illustrations of a front, rear and cross sectional side view of a dual retainer button in accordance with another alternative embodiment of the invention.
Figure 15C:
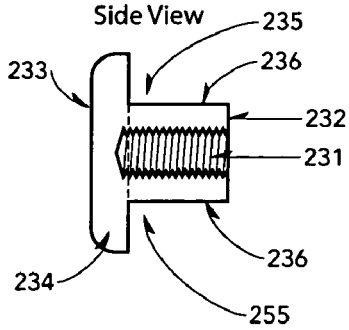
Figure 15B:
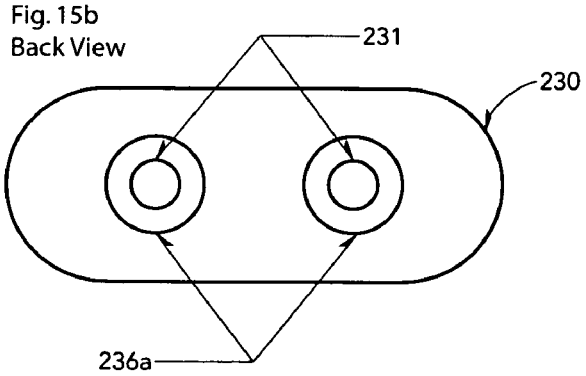

FIGS. 15(*a*), 15(*b*) and 15(*c*) show another embodiment of a retaining button 230 of the dual bolt configuration. Here, a front view, a back view and a side view of the retaining button 230 are shown. With reference to the side view of FIG. 15(*c*), which is a cross sectional view of the retaining button along line $XV_c$-$XV_c$ in FIG. 15(*a*), retaining button 230 includes a rear face 232 and a front face 233. A pair of threaded holes 231 located within a respective cylindrical protrusion that threadably receive a bolt for anchoring a sign panel to a sign post are open to the rear face 232. Each hole 231 is blind so that a respective bolt does not extend completely through the retaining button 230. The front view of FIG. 15(*a*) shows that the front face 233 of the retaining button 230 of this contemplated embodiment is also finished flush, smooth or flat.

With additional reference to FIG. 15(*b*), the back view of the retaining button in accordance with the present embodiment shows the location of the cylindrical protrusions 236*a* about which a respective cylindrical surface 236 extends. When the rear face 232 abuts a sign post, a space 235 is defined between the flanged head 234 and the sign post for receiving opposing edges of two adjacent panels, as shown in FIGS. 8(*a*) and 8(*b*). The dashed circular lines shown in the front view indicates the circumference of the threaded holes 231 and the cylindrical protrusions. The retaining button 230 of the current contemplated embodiment can be used in multi-panel sign systems as the center retaining button of the display (see FIG. 8). An exemplary implementation of the retaining button of FIGS. 15(*a*), 15(*b*) and 15(*c*) is in the sign post configuration shown in FIG. 7 as the center retaining button of a multi-panel assembly.

Figure 16A:
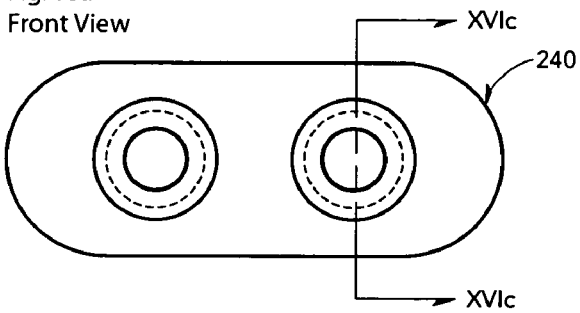
FIGS. 16(*a*), 16(*b*) and 16(*c*) are illustrations of a front, rear, cross sectional side view of a dual retainer button in accordance with an additional alternative embodiment of the invention.
Figure 16C:
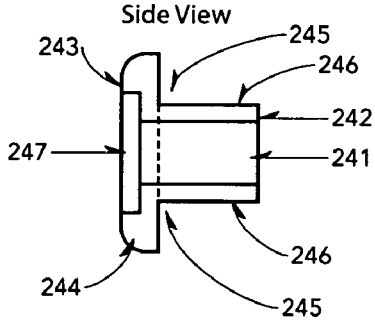
Figure 16B:
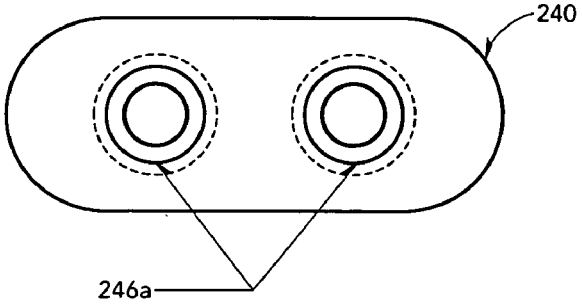

FIGS. 16(*a*), 16(*b*) and 16(*c*) show another embodiment of a retaining button 240 of the dual bolt configuration. Here, a front view, a back view and a side view of the retaining button are shown. With reference to the side view of FIG. 16(*c*), which is a cross sectional view of the retaining button along line $XVI_c$-$XVI_c$ in FIG. 12(*a*), retaining button 240 has a rear face 242 and a front face 243. A pair of through-holes 241 that receive a respective bolt for anchoring a sign panel to a sign post extend completely through the retaining button 240. The retaining button 240 also includes a pair of counter-bored regions 247 that permit a respective bolt head to sit flush with the surface of the retaining button. The retaining button 240 is complementary to retaining button 230 in that a pair of bolts 20 can be inserted through the retaining button 240 on one side of a sign post and threadably received in the retaining button 230 arranged on an opposing side of the sign post to hold both retaining buttons 230, 240 in place (see FIGS. 6(*a*) and 6(*b*). However, it is also possible to utilize retaining button 240 at the front surface to secure the sign panel, where the head of the bolts would rest in a respective counter-bored region disposed around a through-hole and nuts or threaded holes in the sign post receive the bolts.

With specific reference to FIG. 16(*b*), the back view of the retaining button 240 in accordance with the present embodiment shows the location of the cylindrical protrusions 246*a* about which a respective cylindrical surface 246 extends. When the rear face 242 abuts a sign post, a space 245 is defined between the flanged head 244 and the sign post for receiving edges of two adjacent panels, as shown in FIGS. 3(*a*) and 3(*b*). The dashed lines shown in the front view of the retaining button indicate the outer circumference of each of the cylindrical protrusions. The dashed lines shown in the back view indicates the respective outer circumference of each of the counter-bored regions or surfaces in the front face of the retaining button. An exemplary implementation of the retaining button of FIGS. 16(*a*), 16(*b*) and 16(*c*) is in the sign post configuration shown in FIGS. 4 and 5.

In another embodiment, the retaining button is configured for use with either a single bolt or dual bolts. One embodiment of such a retaining button is illustrated in FIGS. 17(*a*)-17(*c*). Here, a front view, a back view and a side view of the button 250 are shown, which may be used as retaining button 17 in, for example, FIGS. 3(*a*) and 3(*b*), FIGS. 6(*a*) and 6(*b*), FIGS. 7(*a*) and 7(*b*) or FIGS. 8(*a*) and 8(*b*). With reference to the side view of FIG. 17(*c*), the retaining button 250 has a rear face 252 and a front face 253. Three threaded holes 251 that threadably receive a bolt for anchoring a sign panel to a sign post are open to the rear face 252. The retaining button 250 includes a retaining element 254 that projects from the front face in a direction substantially perpendicular to each threaded hole 251. The retaining button 250 also has a surface 256 that extends in a direction parallel to the orientation of the threaded hole between the retaining element 254 and the rear face 252. As a result, a space 255 is formed by the retaining element 254 and the surface 256 for engaging and receiving an edge of the sign panel 12. FIG. 17(*d*) shows the top edge of the sign panel 12 received in space 255. However, the retaining button 250 is merely turned upside down to receive a bottom edge of the panel.

In the front view shown in FIG. 17(*a*), the front face 253 of the retaining button 250 is finished continuous, smooth or flat, or with a surface finish or shape that does not impede the function of the retainer button. The threaded holes 251 are blind holes so that the single bolt or two bolts for holding the retaining button 250 to the sign post do not extend completely through the retaining button. By providing the finished face on the retaining button, the surface of a sign panel remains uncompromised when the retaining button is installed to attach the sign panel on the sign post (see FIG. 17(*d*)).

With reference to FIG. 17(*b*), the back view of the retaining button 250 in accordance with the present embodiment shows the surface 256 between the retaining element 254 and the rear surface 252 includes a semi-oval shaped protrusion 256 that corresponds in shape and configuration to the keyed indentation located at the edges of the sign panel 12. The protrusion 256 comprises a semi-oval shaped surface 256*a* that is arranged adjacent the centrally located threaded holes 251 that receive the bolts. In addition, a pair of indentations 256*c* is arranged at either end of the semi-oval shaped surface 256*a* formed adjacent the threaded holes 251. Finally, the surface 256 includes a substantially planar area 256*b* that rests against the flat portion of the edge of the sign panel received in the space 255. An exemplary implementation of the retaining button 250 of FIGS. 17(*a*), 17(*b*) and 17(*c*) is in the sign post configuration shown in, for example, FIGS. 3(*a*) and 3(*b*), FIGS. 6(*a*) and 6(*b*), FIGS. 7(*a*) and 7(*b*) or FIGS. 8(*a*) and 8(*b*).

FIGS. 18(*a*), 18(*b*) and 18(*c*) show another embodiment of a retaining button 260 of the single or dual bolt configuration. Here, a front view, a back view and a side view of the retaining button 260 are shown. With reference to the side view of FIG. 18(*c*), which is a cross sectional view of the retaining button along line $XVII_c$-$XVII_c$ in FIG. 18(*a*), retaining button 260 includes a rear face 262 and a front face 263. Three threaded holes 261 located within an oval protrusion 266*a* that each threadably receive a bolt for anchoring a sign panel to a sign post are open to the rear face 262. Each hole 261 is blind so that a respective bolt does not extend completely through the retaining button 260. The front view of FIG. 18(*a*) shows that the front face 263 of the retaining button 260 of this contemplated embodiment is also finished flush, smooth or flat.

With additional reference to FIG. 18(*b*), the back view of the retaining button in accordance with the present embodiment shows the location of the oval protrusion 266*a* about which a surface 266 extends. When the rear face 262 abuts a sign post, a space 265 is defined between the flanged head 264 and the sign post for receiving opposing edges of two adjacent panels, as shown in, for example, FIGS. 3(*a*) and 3(*b*), FIGS. 6(*a*) and 6(*b*), FIGS. 7(*a*) and 7(*b*) or FIGS. 8(*a*) and 8(*b*). The dashed lines shown in the front view indicates the circumference of the threaded holes 261 and the oval protrusion 266*b*. The retaining button 260 of the current contemplated embodiment can be used in multi-panel sign systems as the center retaining button of the display (see, for example, FIG. 8). An exemplary implementation of the retaining button of FIGS. 18(*a*), 18(*b*) and 18(*c*) is in the sign post configuration shown in FIG. 18(*d*) as the center retaining button of a multi-panel assembly.

FIGS. 19(*a*), 19(*b*) and 19(*c*) show another embodiment of a retaining button 270 of the single bolt configuration. Here, a front view, a back view and a side view of the retaining button 270 are shown. With reference to the side view of FIG. 19(*c*), which is a cross sectional view of the retaining button along line $XVIII_c$-$XVIII_c$ in FIG. 19(*a*), the retaining button 270 has a rear face 272 and a front face 273. A through-hole 271 that receives a bolt for anchoring a sign panel to a sign post extends completely through the retaining button 270. The retaining button includes a retaining element 274 that projects from the front face 273 in a direction substantially perpendicularly to the through-hole 271. The retaining button 270 also has a surface 276 that extends in a direction essentially parallel to the orientation of the through-hole 271 between the retaining element 274 and the rear face 272. As a result, a space 275 is formed by the retaining element 274 and the surface 276 that engages and receives an edge of the sign panel 12. The retaining button also includes a counter-bored region 277 at the front face 273 that permits a bolt head to sit flush with the front face surface of the retaining button 270. The retaining button 270 is complementary to retaining button 250 in that one bolt 20 can be inserted through the retaining button 250 on one side of a sign post and threadably received in the retaining button 270 arranged on an opposing side of the sign post to hold both retaining buttons 250, 270 in place (see FIG. 19(*d*)). However, it is also possible to utilize retaining button 270 alone to secure the sign panel, where the head of the bolt would rest in the counter-bored recess disposed around the through-hole and a nut or threaded hole in the sign post receives the bolt (see FIG. 19(*e*)).

With reference to FIG. 19(*b*), the back view of the retaining button 270 in accordance with the present embodiment shows the surface 276 between the retaining element and the rear face 272 includes a protrusion 276*a* that corresponds in shape and configuration to the keyed indentation located at the edges of the sign panel 12. The protrusion 276*a* comprises a semi-oval surface that is arranged adjacent the centrally located through-hole through which the bolt extends completely through. In addition, a pair of indentations 276*c* is arranged at either end of the semi-oval surface formed adjacent the through-hole 281. Finally, the surface 276 includes a substantially planar area 276*b* of the semi-oval surface that rests against the flat portion of the edge of the sign panel received in the space 275. An exemplary implementation of the retaining button of FIGS. 19(*a*), 19(*b*) and 19(*c*) is in the sign post configuration shown in FIGS. 19(*d*) and 19(*e*), but in a single bolt configuration.

FIGS. 20(*a*), 20(*b*) and 20(*c*) show another embodiment of a retaining button 280 of the single bolt configuration. Here, a front view, a back view and a side view of the retaining button are shown. With reference to the side view of FIG. 20(*c*), which is a cross sectional view of the retaining button along line $XIX_c$-$XIX_c$ in FIG. 20(*a*), retaining button 280 has a rear face 282 and a front face 283. A through-hole 281 that receives a bolt for anchoring a sign panel to a sign post extends completely through the retaining button 280. The retaining button also includes a counter-bored region 287 that permits a bolt head to sit flush with the surface of the retaining button. The retaining button 280 is complementary to retaining button 260 in that one bolt 20 can be inserted through the retaining button 280 on one side of a sign post and threadably received in the retaining button 260 arranged on an opposing side of the sign post to hold both retaining buttons 260, 280 in place (see FIG. 20(*d*)). However, it is also possible to utilize retaining button 280 at the front surface to secure the sign panel, where the head of the bolt would rest in the counter-bored region disposed around the through-hole and a nut or threaded hole in the sign post receives the bolt (see FIG. 20(*e*)).

With specific reference to FIG. 20(*b*), the back view of the retaining button 280 in accordance with the present embodiment shows the location of the oval shaped protrusion about which a surface 286 extends. When the rear face 282 abuts a sign post, a space 285 is defined between the flanged head 284 and the sign post for receiving edges of two adjacent panels, as shown in, for example, FIGS. 3(*a*) and 3(*b*), FIGS. 6(*a*) and 6(*b*), FIGS. 7(*a*) and 7(*b*) or FIGS. 8(*a*) and 8(*b*). The dashed oval line shown in the front view of the retaining button indicates the outer circumference of the oval protrusion 286*a*. Finally, the dashed line shown in the back view indicates the outer circumference of the counter-bored region 287 in the front face of the retaining button. An exemplary implementation of the retaining button of FIGS. 20(*a*), 20(*b*) and 20(*c*) is in the sign post configuration shown, for example, in FIGS. 8(*a*) and 8(*b*), i.e., as a center retaining button of a multi-panel assembly, but in configurations having front and rear sign panels in the manner shown, for example, in FIGS. 6(*a*) and 6(*b*).

FIGS. 21(*a*), 21(*b*) and 21(*c*) show another embodiment of a retaining button 290 of the dual bolt configuration. Here, a front view, a back view and a side view of the retaining button 290 are shown. With reference to the side view of FIG. 21(*c*), which is a cross sectional view of the retaining button along line $XX_c$-$XX_c$ in FIG. 21(*a*), the retaining button 290 has a rear face 292 and a front face 293. A pair of through-holes 291 that receive a respective bolt for anchoring a sign panel to a sign post extend completely through the retaining button 290. The retaining button includes a retaining element 294 that projects from the front face 293 in a direction substantially perpendicularly to the through-hole 291. The retaining button 290 also has a surface 296 that extends in a direction essentially parallel to the orientation of the pair of through-holes 291 between the retaining element 294 and the rear face 292. As a result, a space 295 is formed by the retaining element 294 and the surface 296 that engages and receives an edge of the sign panel 12. The retaining button also includes a counter-bored region 297 at the front face 293 that permits a bolt head to sit flush with the front face surface of the retaining button 290. The retaining button 290 is complementary to retaining button 250 in that a pair of bolts 20 can be inserted through the retaining button 290 on one side of a sign post and threadably received in the retaining button 250 arranged on an opposing side of the sign post to hold both retaining buttons 250, 290 in place. However, it is also possible to utilize retaining button 290 alone to secure the sign panel, where each head of a bolt would rest in the counter-bored recess disposed around a through-hole and nuts or threaded holes in the sign post receive each bolt, respectively (see FIG. 21 (*e*)).

With reference to FIG. 21(*b*), the back view of the retaining button 220 in accordance with the present embodiment shows the surface between the retaining element and the rear face 292 includes a protrusion 296*a* that corresponds in shape and configuration to the keyed indentation located at the edges of the sign panel 12. The protrusion 296*a* comprises a semi-circular shaped surface that is arranged adjacent respective through-holes through which the bolts extend completely through. In addition, a small indentation 226*c* is arranged adjacent each respective end of the semi-circular shaped surface that is formed adjacent each respective through-hole 291. Finally, the surface 296 includes a substantially planar area 296*b* that rests against the flat portion of the edge of the sign panel received in the space 295. An exemplary implementation of the retaining button of FIGS. 21(*a*), 21(*b*) and 21(*c*) is in the sign post configuration shown in FIG. 21(*d*).

FIGS. 22(*a*), 22(*b*) and 22(*c*) show another embodiment of a retaining button 300 of the dual bolt configuration. Here, a front view, a back view and a side view of the retaining button are shown. With reference to the side view of FIG. 22(*c*), which is a cross sectional view of the retaining button along line $XXI_c$-$XXI_c$ in FIG. 22(*a*), retaining button 300 has a rear face 302 and a front face 303. A pair of through-holes 301 that receive a respective bolt for anchoring a sign panel to a sign post extend completely through the retaining button 300. The retaining button 300 also includes a pair of counter-bored regions 307 that permit a respective bolt head to sit flush with the surface of the retaining button. The retaining button 300 is complementary to retaining button 260 in that a pair of bolts 20 can be inserted through the retaining button 300 on one side of a sign post and threadably received in the retaining button 260 arranged on an opposing side of the sign post to hold both retaining buttons 260, 300 in place (see FIGS. 22(*d*) and 22(*e*)). However, it is also possible to utilize retaining button 300 at the front surface to secure the sign panel, where the head of the bolts would rest in a respective counter-bored region disposed around a through-hole and nuts or threaded holes in the sign post receive the bolts (see FIG. 22(*e*)).

With specific reference to FIG. 22(*b*), the back view of the retaining button 240 in accordance with the present embodiment shows the location of the oval shaped protrusion about which a surface 306 extends. When the rear face 302 abuts a sign post, a space 305 is defined between the flanged head 304 and the sign post for receiving edges of two adjacent panels, as shown in FIGS. 3(*a*) and 3(*b*). The dashed lines shown in the front view of the retaining button indicate the outer circumference of the oval protrusion 306*a*. The dashed lines shown in the back view indicates the respective outer circumference of each of the counter-bored regions or surfaces in the front face of the retaining button. An exemplary implementation of the retaining button of FIGS. 22(*a*), 22(*b*) and 22(*c*) is in the sign post configuration shown in FIGS. 4 and 5.

Figure 23A:
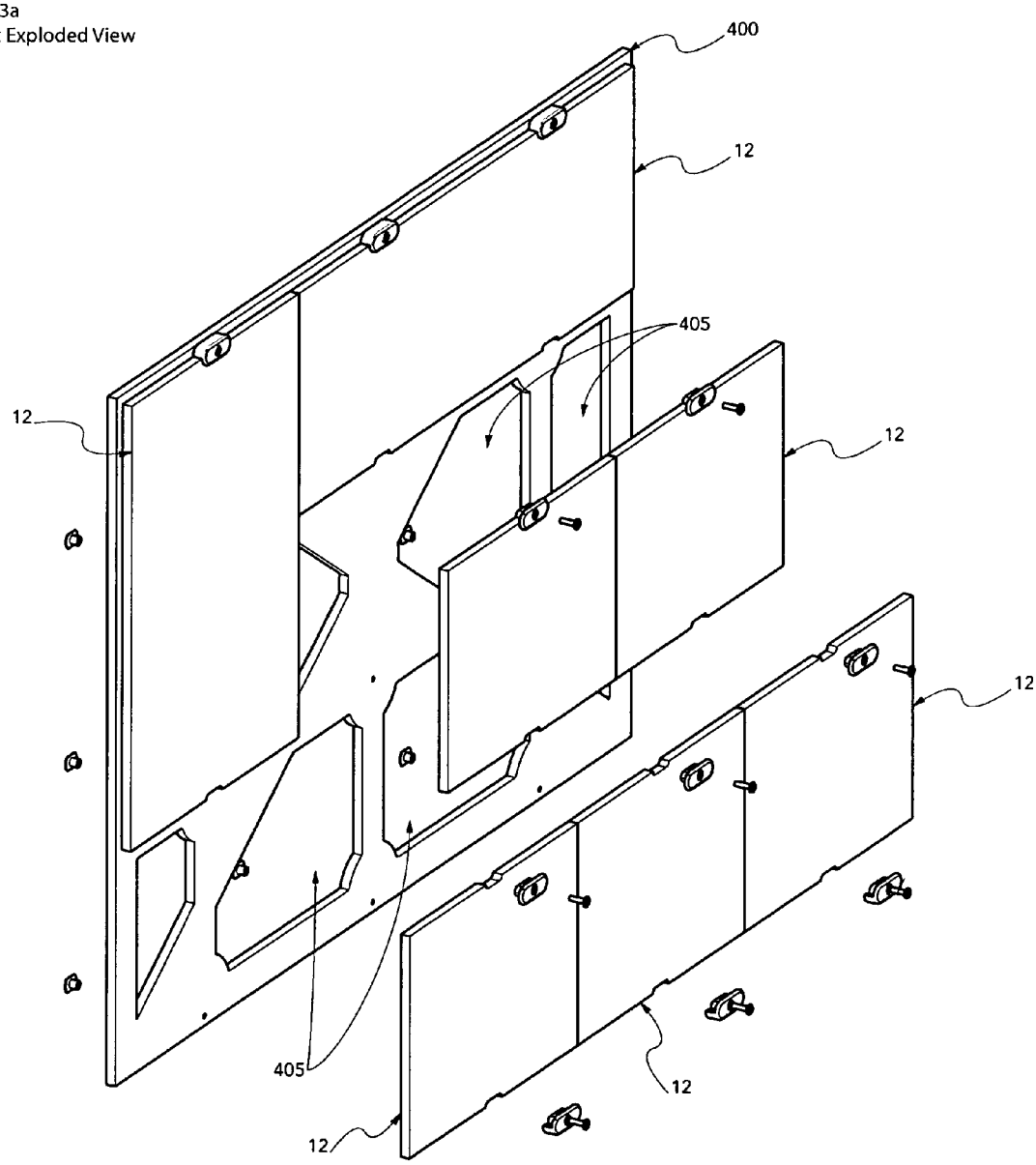
FIGS. 23(*a*) and 23(*b*) are illustrations of a front and rear exploded view of a backer panel in accordance with the invention.
Figure 23B:
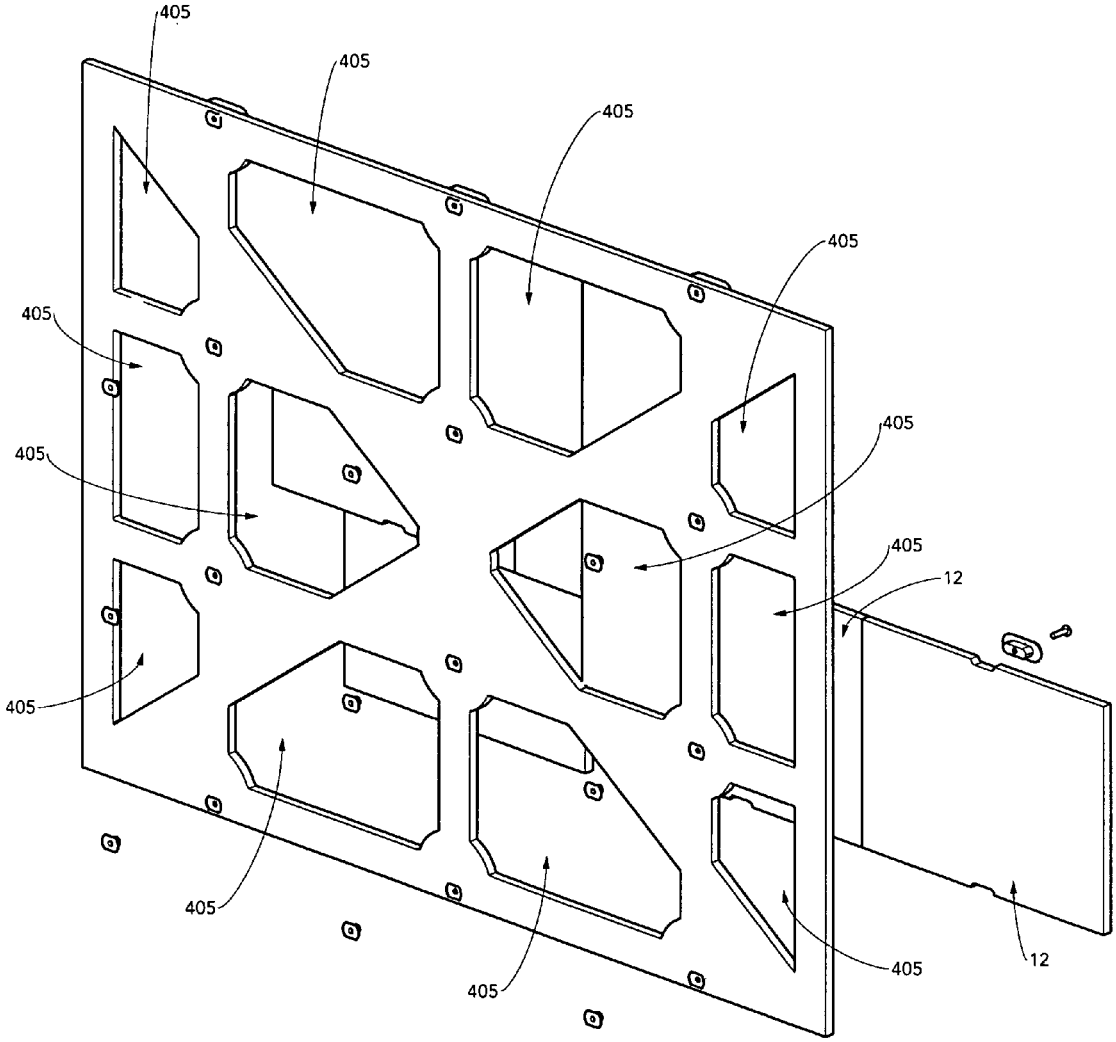

In other contemplated implementations of the retaining buttons of the invention, panels are installed without the use of a sign post structure. One such implementation is shown FIGS. 23(*a*) and 23(*b*) which provide illustrations of a front and rear exploded view of a backer panel 400. In accordance with the contemplated embodiment, the backer panel 400 is used to provide reinforcement in a multiple panel assembly. The backer panel 400 may be provided with cutouts 405 that lighten the structure of the backer panel, without seriously compromising the strength and integrity of the panel. In use, the backer panel 400 may be placed on a wall or freestanding kiosk structure. In accordance with the contemplated embodiment, multiple panels 12 are installed either horizontally or vertically, and the retaining buttons of the contemplated embodiments of the invention are used to retain the panels as a single secure unit.

Thus, while there have been shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements which perform substantially the same function in substantially the same way to achieve the same results are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A sign system, comprising:

at least one vertically arranged support;

a sign panel having top and bottom edges and disposed on the at least one vertically arranged support having at least one keyed indentation or protrusion located at one of the top and bottom edges of the sign panel to permit capture and rigid securement of the sign panel to the at least one vertically arranged support; and at least two fastening devices connectable to the vertically arranged support and having a complimentary indentation or protrusion that corresponds in shape and configuration to the at least one keyed indentation or protrusion of the sign panel to permit capture and rigid securement of the sign panel, wherein the one of the top and bottom edges has straight sections on either side of the at least one keyed indentation or protrusion and one of the at least two fastening devices has flat sections corresponding to the straight sections, and wherein when the at least two fastening devices are connected to the at least one vertically arranged support and the indentation or protrusion of the at least two fastening devices is engaged and seated in the at least one keyed indentation or protrusion of the sign panel, the sign panel is locked in place such that lateral movement or removal of the panel from the at least one vertically arranged support is prevented.

2. The sign system of claim 1, wherein each of the at least two fastening devices comprises a machined metal fitting.

3. The sign system of claim 1, wherein each of the at least two fastening devices is manufactured in a shape that is symmetrical along its central axis.

4. The sign system of claim 1, wherein each of the at least two fastening devices include at least one centrally located internally machined hole located at the rear of the device for receiving at least one bolt.

5. The sign system of claim 4, wherein the protrusion comprises at least one semi-circular surface circumferentially arranged around the at least one centrally located machined hole that receives the at least one bolt.

6. The sign system of claim 4, wherein each of the at least two fastening devices include a retaining element that extends perpendicularly to the at least one centrally located internally machined hole of each of the at least two fastening devices.

7. The sign system of claim 4, wherein each of the at least two fastening devices include a surface that extends in a direction parallel to an orientation of the least one centrally located internally machined hole.

8. The sign system of claim 4, wherein each of the at least two fastening devices include a retaining element that extends perpendicularly to the at least one centrally located internally machined hole of each of the at least two fastening devices and a surface that extends in a direction parallel to an orientation of the least one centrally located internally machined hole;

wherein the retaining element and the surface form a space that engages and receives an edge of the sign panel to permit the rigid securement and capture of the sign panel.

9. The sign system of claim 1, wherein a front face of each of the at least two fastening devices is continuous and uninterrupted such that a bolt does not extend completely through each of the at least two fastening devices.

10. The sign system of claim 1, wherein the protrusion comprises at least one semi-circular surface circumferentially arranged around at least one centrally located threaded hole that receives a respective bolt.

11. The sign system of claim 1, further comprising:

at least two second fastening devices arranged opposite and respectively aligned with each of the at least two fastening devices at a rear face of the at least one vertically arranged support.

12. The sign system of claim 11, wherein each of the at least two second fastening devices has a through-hole and each of said at least two fastening devices has a threaded hole, whereby the first and second devices are fastenable by one bolt to said at least one vertical support.

13. The sign system of claim 1, wherein a face of each of the at least two fastening devices is finished flush, smooth or flat, or with a surface finish that does not impede the function of the each of the at least two fastening devices.

14. The sign system of claim 1, wherein a face of each of the at least two fastening devices is finished flush, smooth or flat, or with a surface finish that does not impede the function of the each of the at least two fastening devices.

15. The sign system of claim 1, wherein a face of each of the at least two fastening devices is finished flush, smooth or flat, or with a surface finish that does not impede the function of the each of the at least two fastening devices.

16. The sign system of claim 1, wherein a face of each of the at least two fastening devices is finished flush, smooth or flat, or with a surface finish that does not impede the function of the each of the at least two fastening devices.

17. The sign system of claim 1, wherein each of the at least two fastening devices has a width not greater than a width of the at least one vertically arranged support, and said sign panel extends laterally from both sides of each of said at least two fastening devices.

18. The sign system of claim 1, wherein each of the top and bottom edges includes the at least one keyed indentation or protrusion and each of the at least two fastening devices includes the complementary indentation or protrusion, and wherein each of the top and bottom edges has straight sections on either side of the at least one keyed indentation or protrusion and each of the at least two fastening devices has flat sections corresponding to the straight sections.

19. A sign system, comprising:

at least one vertical support having a width;

first and second sign panels arranged on opposing sides of said at least one vertical support, each having an upper edge and a lower edge, each of said upper edges and said lower edges having one of a protrusion or indentation;

a first complementary pair of front and rear fastening devices arranged on opposing sides of said at least one vertical post, each of the front and rear fastening having the other of the protrusion or indentation for respectively engaging the protrusion or indentation at the lower edges of said first and second sign panels, and an extension spaced from said at least one vertical post and defining a space in which a portion of said lower edge of a respective one of said first and second sign panels is received; and a second complementary pair of front and rear fastening devices arranged on opposing sides of said at least one vertical post, each of the front and rear fastening devices of the second complementary pair having the other of the protrusion or indentation for respectively engaging the protrusion or indentation at the upper edges of said first and second sign panels, and an extension spaced from said at least one vertical post and defining a space in which a portion of said upper edge of a respective one of said first and second sign panels is received, each of the upper edges and lower edges having straight sections on either side of said at least one key indentation or protrusion and each of the first complementary pair of front and rear fastening devices and the second complementary pair of front and rear fastening devices has flat sections corresponding to the straight sections, each of said front fastening devices having a blind threaded hole and each of said rear fastening devices having through-holes, wherein each of said first complementary pair and second complementary pair is fastenable to said at least one vertical support using only a single bolt.

20. A sign system, comprising:

at least one vertical support having a width;

first and second sign panels arranged one on top of the other on one side of said at least one vertical support, each having an upper edge and a lower edge, each of said upper edges and said lower edges having one of a protrusion or indentation;

an upper fastening device arranged holding said top edge of said first sign panel, a center fastening device holding said bottom edge of said first sign panel and said upper edge of said second sign panel, and a lower fastening device holding said bottom edge of said second panel, each of said upper and lower fastening devices having the other of the protrusion or indentation for respectively engaging the protrusion or indentation at the upper edge of said first sign panel and the lower edge of said second sign panel, and an extension spaced from said at least one vertical post and defining a space in which a portion of said upper edge of said first sign panel and lower edge of said second sign panel are respectively received, said center fastening device having the other of the protrusion or indentation for engaging said lower edge of said first panel and said upper edge of said second panel, and a flange spaced from said at least one vertical support defining a space in which a portion of said lower edge of said first sign panel and a portion of said upper edge of said second sign panel are received, wherein the upper edge of the first panel and the lower edge of the second panel have straight sections on either side of the one of the protrusion or indentation, and each of the upper and lower fastening devices has flat sections corresponding to the straight sections.

* * * * *